US011725395B2

(12) United States Patent
Nilsson et al.

(10) Patent No.: US 11,725,395 B2
(45) **Date of Patent: *Aug. 15, 2023**

(54) RESILIENT FLOOR

(71) Applicant: Välinge Innovation AB, Viken (SE)

(72) Inventors: Mats Nilsson, Viken (SE); Per Nygren, Ramlösa (SE)

(73) Assignee: Välinge Innovation AB, Viken (SE)

( * ) Notice: Subject to any disclaimer, the term of this patent is extended or adjusted under 35 U.S.C. 154(b) by 0 days.

This patent is subject to a terminal disclaimer.

(21) Appl. No.: 17/694,843

(22) Filed: Mar. 15, 2022

(65) Prior Publication Data

US 2022/0341186 A1 Oct. 27, 2022

Related U.S. Application Data

(63) Continuation of application No. 16/713,431, filed on Dec. 13, 2019, now Pat. No. 11,306,486, which is a continuation of application No. 16/027,465, filed on Jul. 5, 2018, now Pat. No. 10,526,793, which is a continuation of application No. 14/982,608, filed on Dec. 29, 2015, now Pat. No. 10,047,527, which is a continuation of application No. 14/272,895, filed on (Continued)

(51) Int. Cl.

| | |
|---|---|
| ***E04F 15/02*** | (2006.01) |
| ***E04F 15/10*** | (2006.01) |
| ***E04B 5/00*** | (2006.01) |

(52) U.S. Cl.

CPC ..... *E04F 15/02038* (2013.01); *E04B 5/00* (2013.01); *E04F 15/10* (2013.01); *E04F 15/105* (2013.01); *E04F 2201/0138* (2013.01); *E04F 2201/0146* (2013.01); *E04F 2201/0153* (2013.01); *Y10T 29/49623* (2015.01)

(58) Field of Classification Search

CPC ... E04F 15/02038; E04F 15/10; E04F 15/105; E04F 2201/0138; E04F 2201/0146; E04F 2201/0153

See application file for complete search history.

(56) References Cited

U.S. PATENT DOCUMENTS

| | | | |
|---|---|---|---|
| 213,740 | A | 4/1879 | Conner |
| 1,018,987 | A | 2/1912 | Philpot et al. |

(Continued)

FOREIGN PATENT DOCUMENTS

| | | | |
|---|---|---|---|
| CA | 1171079 | A | 7/1984 |
| CA | 1237344 | A | 5/1988 |

(Continued)

OTHER PUBLICATIONS

Boo, U.S. Appl. No. 17/865,772 entitled "Floorboards Provided With a Mechanical Locking System", filed Jul. 15, 2022.

(Continued)

*Primary Examiner* — Adriana Figueroa
(74) *Attorney, Agent, or Firm* — Boone IP Law

(57) ABSTRACT

A method of assembling resilient floorboards is disclosed that includes the step of bending an edge of a floorboard during the assembling. The bending reduces the force required for connection of the edge to another edge of a juxtaposed floorboard. The floorboards may be provided with a mechanical locking system for vertical and horizontal locking of two adjacent floorboards.

18 Claims, 9 Drawing Sheets

Related U.S. Application Data

May 8, 2014, now Pat. No. 9,249,581, which is a continuation of application No. 13/734,406, filed on Jan. 4, 2013, now Pat. No. 8,756,899, which is a continuation of application No. 12/875,293, filed on Sep. 3, 2010, now Pat. No. 8,365,499.

(60) Provisional application No. 61/239,927, filed on Sep. 4, 2009.

(56) References Cited

U.S. PATENT DOCUMENTS 1,361,501 A 12/1920 Schepmoes
1,394,120 A 10/1921 Rockwell
1,723,306 A 8/1929 Sipe
1,743,492 A 1/1930 Sipe
1,787,027 A 12/1930 Wasleff
1,925,070 A 8/1933 Livezey
1,946,646 A 2/1934 Storm
1,946,690 A 2/1934 Haines
2,015,813 A 10/1935 Nielsen
2,088,238 A 7/1937 Greenway
2,089,075 A 8/1937 Siebs
2,142,305 A 1/1939 Davis
2,204,675 A 6/1940 Grunert
2,266,464 A 12/1941 Kraft
2,303,745 A 12/1942 Karreman
2,306,295 A 12/1942 Casto
2,355,834 A 8/1944 Webb
2,497,837 A 2/1950 Nelson
2,740,167 A 4/1956 Rowley
2,769,726 A 11/1956 Wetterau et al.
2,818,895 A 1/1958 Zuber
2,863,185 A 12/1958 Riedi
2,872,712 A 2/1959 Brown et al.
2,947,040 A 8/1960 Schultz
3,055,461 A 9/1962 De Ridder
3,077,703 A 2/1963 Bergstrom
3,087,269 A 4/1963 Hudson
3,120,033 A 2/1964 Andres
3,120,083 A 2/1964 Dahlberg et al.
3,247,638 A 4/1966 Gay, Jr.
3,259,417 A 7/1966 Chapman
3,310,919 A 3/1967 Bue et al.
3,397,496 A 8/1968 Sohns
3,436,888 A 4/1969 Ottosson
3,538,665 A 11/1970 Gohner
3,554,850 A 1/1971 Kuhle
3,578,548 A 5/1971 Wesp
3,619,961 A 11/1971 Sterrett et al.
3,619,963 A 11/1971 Omholt
3,623,288 A 11/1971 Horowitz
3,657,852 A 4/1972 Worthington et al.
3,694,983 A 10/1972 Couquet
3,720,027 A 3/1973 Christensen
3,742,669 A 7/1973 Mansfeld
3,760,547 A 9/1973 Brenneman
3,857,749 A 12/1974 Yoshida
3,883,258 A 5/1975 Hewson
3,919,820 A 11/1975 Green
3,937,861 A 2/1976 Zuckerman et al.
3,946,529 A 3/1976 Chevaux
3,950,915 A 4/1976 Cole
4,023,596 A 5/1977 Tate
4,037,377 A 7/1977 Howell et al.
4,100,710 A 7/1978 Kowallik
4,113,399 A 9/1978 Hansen, Sr.
4,169,688 A 10/1979 Toshio
4,170,859 A 10/1979 Counihan
4,172,169 A 10/1979 Mawson et al.
4,176,210 A 11/1979 Skinner
4,180,615 A 12/1979 Bettoli
4,187,131 A 2/1980 Graham et al.
4,196,554 A 4/1980 Anderson et al.
4,226,064 A 10/1980 Kraayenhof
4,242,390 A 12/1980 Nemeth
4,296,017 A 10/1981 Weissgerber et al.
4,299,070 A 11/1981 Oltmanns et al.
4,312,686 A 1/1982 Smith et al.
4,313,866 A 2/1982 Renshaw
4,315,724 A 2/1982 Taoka et al.
4,333,987 A 6/1982 Kwart et al.
4,393,187 A 7/1983 Boba et al.
4,396,566 A 8/1983 Brinkmann et al.
4,423,178 A 12/1983 Renshaw
4,426,820 A 1/1984 Terbrack et al.
4,454,699 A 6/1984 Strobl
4,489,115 A 12/1984 Layman et al.
4,507,188 A 3/1985 Chu
4,512,131 A 4/1985 Laramore
4,526,418 A 7/1985 Martin
4,570,353 A 2/1986 Evans et al.
4,574,099 A 3/1986 Nixon
4,599,841 A 7/1986 Haid
4,610,900 A 9/1986 Nishibori
4,614,680 A 9/1986 Fry et al.
4,724,187 A 2/1988 Ungar et al.
4,759,164 A 7/1988 Abendroth et al.
4,769,963 A 9/1988 Meyerson
4,772,500 A 9/1988 Stroppiana
4,785,065 A 11/1988 Uhl et al.
4,788,088 A 11/1988 Kohl
4,807,412 A * 2/1989 Frederiksen ..... E04F 15/105 52/180
4,849,768 A 7/1989 Graham
4,944,514 A 7/1990 Suiter
4,947,595 A 8/1990 Douds et al.
4,976,221 A 12/1990 Yetter
5,007,222 A 4/1991 Raymond
5,050,362 A 9/1991 Tal et al.
5,052,158 A 10/1991 D Luzansky
5,076,034 A 12/1991 Bandy
5,112,671 A 5/1992 Diamond et al.
5,134,026 A 7/1992 Melcher
5,148,850 A 9/1992 Urbanick
5,162,141 A 11/1992 Davey et al.
5,182,892 A 2/1993 Chase
5,185,193 A 2/1993 Phenicie et al.
5,229,217 A 7/1993 Holzer
5,274,979 A 1/1994 Tsai
5,295,341 A 3/1994 Kajiwara
5,322,335 A 6/1994 Niemi
5,333,429 A 8/1994 Cretti
5,344,700 A 9/1994 McGath et al.
5,348,778 A 9/1994 Knipp et al.
5,349,796 A 9/1994 Meyerson
5,367,844 A 11/1994 Diedrich
5,380,794 A 1/1995 Schaefer et al.
5,433,806 A 7/1995 Pasquali et al.
5,441,677 A 8/1995 Phillips, Sr.
5,458,953 A 10/1995 Wang et al.
5,465,546 A 11/1995 Buse
5,480,602 A 1/1996 Nagaich
5,502,939 A 4/1996 Zadok et al.
5,503,788 A 4/1996 Lazareck et al.
5,516,472 A 5/1996 Laver
5,548,937 A 8/1996 Shimonohara
5,553,427 A 9/1996 Andres
5,613,339 A 3/1997 Pollock
5,618,602 A 4/1997 Nelson
5,630,304 A 5/1997 Austin
5,642,592 A 7/1997 Andres
5,647,184 A 7/1997 Davis
5,653,099 A 8/1997 MacKenzie
5,660,016 A 8/1997 Erwin et al.
5,662,977 A 9/1997 Spain et al.
5,670,237 A 9/1997 Shultz et al.
5,671,575 A 9/1997 Wu
5,694,730 A 12/1997 Del et al.
5,706,621 A 1/1998 Pervan
5,713,165 A 2/1998 Erwin
5,724,909 A 3/1998 Pitman et al.
5,728,476 A 3/1998 Harwood et al.
5,755,068 A 5/1998 Ormiston

(56) References Cited

U.S. PATENT DOCUMENTS 5,758,466 A 6/1998 Tucker
5,777,014 A 7/1998 Hopper et al.
5,780,147 A 7/1998 Sugahara et al.
5,791,113 A 8/1998 Glowa et al.
5,797,237 A * 8/1998 Finkell, Jr. ..... E04F 15/04 52/586.1
5,833,386 A 11/1998 Rosan et al.
5,836,128 A 11/1998 Groh et al.
5,856,389 A 1/1999 Kostrzewski et al.
5,858,160 A 1/1999 Piacente et al.
5,863,632 A 1/1999 Bisker
5,869,138 A 2/1999 Nishibori
D406,360 S 3/1999 Finkell, Jr.
5,900,099 A 5/1999 Sweet et al.
5,950,389 A 9/1999 Porter
5,989,668 A 11/1999 Nelson et al.
6,004,417 A 12/1999 Roesch et al.
6,006,486 A 12/1999 Moriau et al.
6,023,907 A 2/2000 Pervan
6,027,599 A 2/2000 Wang
6,029,416 A 2/2000 Andersson
6,052,960 A 4/2000 Yonemura
6,065,262 A 5/2000 Motta
6,093,473 A 7/2000 Min
6,101,778 A 8/2000 Maartensson
6,139,945 A 10/2000 Krejchi et al.
6,173,548 B1 1/2001 Hamar et al.
6,182,410 B1 2/2001 Pervan
6,189,282 B1 2/2001 Vanderwerf
6,209,278 B1 4/2001 Tychsen
6,216,409 B1 4/2001 Roy et al.
6,233,899 B1 5/2001 Mellert et al.
6,260,326 B1 7/2001 M ugrave ller-Hartburg
6,291,078 B1 9/2001 Chen et al.
6,314,701 B1 11/2001 Meyerson
6,324,809 B1 12/2001 Nelson
6,332,733 B1 12/2001 Hamberger et al.
6,345,481 B1 2/2002 Nelson
6,363,677 B1 4/2002 Chen et al.
6,397,547 B1 6/2002 Maartensson
6,438,919 B1 8/2002 Knauseder
6,446,405 B1 9/2002 Pervan
6,455,127 B1 9/2002 Valtanen
6,460,306 B1 10/2002 Nelson
6,490,836 B1 12/2002 Moriau et al.
6,505,452 B1 1/2003 Hannig et al.
6,536,178 B1 3/2003 Paalsson et al.
6,546,691 B2 4/2003 Leopolder
6,553,724 B1 4/2003 Bigler
6,558,070 B1 5/2003 Valtanen
6,591,568 B1 7/2003 Paalsson
6,617,009 B1 9/2003 Chen et al.
6,647,690 B1 11/2003 Martensson
6,671,968 B2 1/2004 Shannon
6,672,030 B2 * 1/2004 Schulte ..... E04F 15/04 52/592.4
6,675,545 B2 1/2004 Chen et al.
6,695,944 B2 2/2004 Courtney
6,711,869 B2 3/2004 Tychsen
6,715,253 B2 4/2004 Pervan
6,729,091 B1 5/2004 Martensson
6,761,008 B2 7/2004 Chen et al.
6,763,643 B1 7/2004 Maartensson
6,766,622 B1 7/2004 Thiers
6,769,218 B2 * 8/2004 Pervan ..... E04F 15/04 52/592.1
6,769,219 B2 8/2004 Schwitte et al.
6,772,568 B2 8/2004 Thiers et al.
6,786,019 B2 9/2004 Thiers
6,790,512 B2 9/2004 MacQueen et al.
6,804,926 B1 10/2004 Eisermann
6,835,421 B1 12/2004 Doehring
6,851,237 B2 2/2005 Niese et al.
6,851,241 B2 2/2005 Pervan
6,854,235 B2 2/2005 Martensson
6,862,857 B2 3/2005 Tychsen
6,865,855 B2 3/2005 Knauseder
6,874,291 B1 4/2005 Weber
6,874,292 B2 4/2005 Moriau et al.
6,880,305 B2 4/2005 Pervan et al.
6,880,307 B2 4/2005 Schwitte et al.
6,895,881 B1 5/2005 Whitaker
6,898,911 B2 5/2005 Kornfalt et al.
6,898,913 B2 5/2005 Pervan
6,918,220 B2 7/2005 Pervan
6,922,964 B2 8/2005 Pervan
6,922,965 B2 8/2005 Rosenthal et al.
6,928,779 B2 8/2005 Moriau et al.
6,933,043 B1 8/2005 Son et al.
6,955,020 B2 10/2005 Moriau et al.
6,966,963 B2 11/2005 O'Connor
6,986,934 B2 1/2006 Chen et al.
7,051,486 B2 5/2006 Pervan
7,086,205 B2 8/2006 Pervan
7,090,430 B1 8/2006 Fletcher et al.
D528,671 S 9/2006 Grafenauer
7,121,058 B2 10/2006 Palsson et al.
7,127,860 B2 10/2006 Pervan et al.
7,137,229 B2 11/2006 Pervan
7,152,383 B1 12/2006 Wilkinson et al.
7,155,871 B1 1/2007 Stone et al.
7,169,460 B1 1/2007 Chen et al.
7,171,791 B2 * 2/2007 Pervan ..... E04F 15/04 52/592.1
7,211,310 B2 5/2007 Chen et al.
7,251,916 B2 8/2007 Konzelmann et al.
7,275,350 B2 10/2007 Pervan et al.
7,328,536 B2 2/2008 Moriau et al.
7,337,588 B1 3/2008 Moebus
7,356,971 B2 4/2008 Pervan
7,377,081 B2 5/2008 Ruhdorfer
7,386,963 B2 6/2008 Pervan
7,398,625 B2 7/2008 Pervan
7,419,717 B2 9/2008 Chen et al.
7,451,578 B2 11/2008 Hannig
7,454,875 B2 11/2008 Pervan et al.
7,484,337 B2 2/2009 Hecht
7,516,588 B2 4/2009 Pervan
7,533,500 B2 5/2009 Morton et al.
7,543,418 B2 6/2009 Weitzer
7,552,568 B2 6/2009 Paalsson et al.
7,568,322 B2 8/2009 Pervan
7,584,583 B2 9/2009 Bergelin et al.
7,603,826 B1 10/2009 Moebus
7,607,271 B2 10/2009 Griffin et al.
7,614,197 B2 11/2009 Nelson
7,617,645 B2 11/2009 Moriau et al.
7,617,651 B2 11/2009 Grafenauer
7,621,094 B2 11/2009 Moriau et al.
7,634,886 B2 12/2009 Moriau et al.
7,634,887 B2 12/2009 Moriau et al.
7,637,066 B2 12/2009 Moriau et al.
7,640,708 B2 1/2010 Moriau et al.
7,644,555 B2 1/2010 Moriau et al.
7,644,557 B2 1/2010 Moriau et al.
7,647,743 B2 1/2010 Moriau et al.
7,650,728 B2 1/2010 Moriau et al.
7,654,054 B2 2/2010 Moriau et al.
7,658,048 B2 2/2010 Moriau et al.
7,677,001 B2 3/2010 Pervan
7,678,215 B2 3/2010 Martin et al.
7,716,896 B2 5/2010 Pervan
7,739,849 B2 * 6/2010 Pervan ..... B44C 3/12 52/582.1
7,763,345 B2 7/2010 Chen et al.
7,779,597 B2 * 8/2010 Thiers ..... E04F 15/107 52/390
7,802,415 B2 9/2010 Pervan et al.
7,841,144 B2 11/2010 Pervan
7,841,150 B2 11/2010 Pervan
7,856,784 B2 12/2010 Martensson
7,856,789 B2 * 12/2010 Eisermann ..... E04F 15/04 52/747.1
7,861,482 B2 1/2011 Pervan et al.

(56) References Cited

U.S. PATENT DOCUMENTS 7,866,110 B2 1/2011 Pervan
7,866,115 B2 1/2011 Pervan et al.
7,874,118 B2 1/2011 Schitter
7,886,497 B2 2/2011 Pervan
7,896,571 B1 3/2011 Hannig et al.
7,908,816 B2 3/2011 Grafenauer et al.
7,926,234 B2 4/2011 Pervan et al.
7,930,862 B2 4/2011 Bergelin et al.
7,958,689 B2 6/2011 Lei
7,980,043 B2 7/2011 Moebus
7,984,600 B2 7/2011 Alford et al.
8,006,460 B2 8/2011 Chen et al.
8,021,741 B2 9/2011 Chen et al.
8,028,486 B2 10/2011 Pervan et al.
8,033,074 B2 10/2011 Pervan et al.
8,037,656 B2 10/2011 Liu et al.
8,038,363 B2 10/2011 Hannig et al.
8,042,311 B2 10/2011 Pervan et al.
8,071,193 B2 12/2011 Windmoeller
8,091,238 B2 1/2012 Hannig
8,099,924 B2 1/2012 Braun
8,112,891 B2 2/2012 Pervan
8,132,384 B2 3/2012 Hannig
8,166,718 B2 5/2012 Liu
8,191,333 B2 6/2012 Braun
8,196,366 B2 6/2012 Thiers et al.
8,215,078 B2 7/2012 Pervan
8,234,829 B2 8/2012 Thiers et al.
8,245,478 B2 8/2012 Bergelin
8,281,549 B2 10/2012 Du
8,293,058 B2 10/2012 Pervan et al.
8,302,361 B2 11/2012 Braun et al.
8,353,140 B2 1/2013 Pervan et al.
8,356,452 B2 1/2013 Thiers et al.
8,365,499 B2 2/2013 Nilsson et al.
8,375,672 B2 2/2013 Hannig
8,375,674 B2 2/2013 Braun et al.
8,480,841 B2 7/2013 Pervan et al.
8,484,924 B2 7/2013 Braun
8,490,361 B2 7/2013 Curry et al.
8,499,521 B2 8/2013 Pervan et al.
8,511,031 B2 8/2013 Bergelin
8,511,040 B2 8/2013 Braun et al.
8,544,231 B2 10/2013 Hannig
8,544,232 B2 10/2013 Wybo et al.
8,544,234 B2 10/2013 Pervan et al.
8,584,423 B2 11/2013 Pervan et al.
8,613,826 B2 12/2013 Pervan et al.
8,658,274 B2 2/2014 Chen et al.
8,683,698 B2 4/2014 Pervan et al.
8,689,512 B2 4/2014 Pervan
8,707,651 B2 4/2014 Stockl
8,720,149 B2 5/2014 Bossuyt
8,726,604 B2 5/2014 Hannig
8,745,952 B2 6/2014 Perra et al.
8,756,899 B2 6/2014 Nilsson et al.
8,763,340 B2 7/2014 Pervan et al.
8,800,150 B2 8/2014 Pervan
8,806,832 B2 8/2014 Kell
8,833,028 B2 9/2014 Whispell et al.
8,834,992 B2 9/2014 Chen et al.
8,952,078 B2 2/2015 Gould
8,966,853 B2 3/2015 Hannig
8,978,336 B2 3/2015 Perra et al.
9,103,126 B2 8/2015 Kell
9,212,492 B2 12/2015 Pervan et al.
9,217,250 B2 12/2015 Perra et al.
9,222,267 B2 12/2015 Bergelin
9,228,360 B2 1/2016 Schneider
9,249,581 B2 2/2016 Nilsson et al.
9,260,870 B2 2/2016 Vermeulen et al.
9,296,191 B2 3/2016 Pervan et al.
9,314,936 B2 4/2016 Pervan
9,371,653 B2 6/2016 Liu
9,410,328 B2 8/2016 Pervan
9,528,278 B2 12/2016 Cappelle
9,650,792 B2 5/2017 Ramachandra
9,695,600 B2 7/2017 Vandevoorde et al.
9,695,601 B2 7/2017 Whispell et al.
9,695,851 B2 7/2017 Hannig
9,714,515 B2 7/2017 Pervan
9,745,758 B2 8/2017 Baert et al.
9,765,530 B2 9/2017 Bergelin et al.
9,777,487 B2 10/2017 Pervan et al.
9,803,374 B2 10/2017 Pervan
9,816,270 B2 11/2017 Pervan et al.
9,856,657 B2 1/2018 Thiers et al.
9,874,035 B2 1/2018 Wagner
9,885,186 B2 2/2018 Liu
9,885,187 B2 2/2018 Kell
10,000,935 B2 6/2018 Kell
10,047,527 B2 8/2018 Nilsson et al.
10,059,084 B2 8/2018 Lundblad et al.
10,113,318 B2 10/2018 Cappelle et al.
10,137,659 B2 11/2018 Pervan
10,214,917 B2 2/2019 Pervan et al.
10,287,777 B2 5/2019 Boo
10,301,830 B2 5/2019 Boo
10,316,526 B2 6/2019 Kell
10,344,379 B2 7/2019 Pervan et al.
10,407,919 B2 9/2019 Boo
10,450,760 B2 10/2019 Bergelin et al.
10,486,399 B2 11/2019 Chen et al.
10,493,731 B2 12/2019 Lundblad et al.
10,526,793 B2 1/2020 Nilsson et al.
10,704,269 B2 7/2020 Whispell et al.
10,780,676 B2 9/2020 Lundblad et al.
10,808,410 B2 10/2020 Boo et al.
10,837,181 B2 11/2020 Josefsson et al.
10,844,612 B2 11/2020 Boo
10,851,549 B2 12/2020 Boo
10,865,571 B2 12/2020 Kell
10,975,580 B2 4/2021 Pervan et al.
10,982,449 B2 4/2021 Kell
11,066,836 B2 7/2021 Bergelin et al.
2001/0021431 A1 9/2001 Chen et al.
2001/0036557 A1 11/2001 Ingrim et al.
2002/0007606 A1 1/2002 Kettler et al.
2002/0007608 A1 1/2002 Pervan
2002/0007609 A1 1/2002 Pervan
2002/0023702 A1 2/2002 Kettler
2002/0031646 A1 3/2002 Chen et al.
2002/0046433 A1 4/2002 Sellman et al.
2002/0056245 A1 5/2002 Thiers
2002/0069611 A1 6/2002 Leopolder
2002/0083673 A1 7/2002 Kettler et al.
2002/0092263 A1 7/2002 Schulte
2002/0095894 A1 7/2002 Pervan
2002/0100231 A1 8/2002 Miller et al.
2002/0112429 A1 8/2002 Niese et al.
2002/0112433 A1 8/2002 Pervan
2002/0142135 A1 10/2002 Chen et al.
2002/0152707 A1 10/2002 Martensson
2002/0170257 A1 11/2002 McLain et al.
2002/0170258 A1 11/2002 Schwitte et al.
2002/0170259 A1 11/2002 Ferris
2002/0178674 A1 12/2002 Pervan
2002/0178681 A1 12/2002 Zancai et al.
2002/0189183 A1 12/2002 Ricciardelli
2003/0009971 A1 1/2003 Palmberg
2003/0024199 A1 2/2003 Pervan et al.
2003/0024200 A1 2/2003 Moriau et al.
2003/0033777 A1 2/2003 Thiers et al.
2003/0037504 A1 2/2003 Schwitte et al.
2003/0041545 A1 3/2003 Stanchfield
2003/0084636 A1 5/2003 Pervan
2003/0101674 A1 6/2003 Pervan et al.
2003/0101681 A1 6/2003 Tychsen
2003/0110720 A1 6/2003 Berard et al.
2003/0140478 A1 7/2003 Olofsson
2003/0154676 A1 8/2003 Schwartz
2003/0180091 A1 9/2003 Stridsman
2003/0188504 A1 10/2003 Ralf
2003/0196397 A1 10/2003 Niese et al.

(56) References Cited

U.S. PATENT DOCUMENTS

2003/0196405 A1 10/2003 Pervan
2003/0224147 A1 12/2003 Maine et al.
2004/0003888 A1 1/2004 Mott et al.
2004/0031225 A1 2/2004 Fowler
2004/0031227 A1 2/2004 Knauseder
2004/0035078 A1 2/2004 Pervan
2004/0049999 A1 3/2004 Krieger
2004/0060255 A1 4/2004 Knauseder
2004/0068954 A1 4/2004 Martensson
2004/0107659 A1 6/2004 Glockl
2004/0128934 A1 7/2004 Hecht
2004/0137180 A1 7/2004 Sjoberg et al.
2004/0139678 A1 7/2004 Pervan
2004/0168392 A1 9/2004 Konzelmann et al.
2004/0177584 A1 9/2004 Pervan
2004/0182036 A1 9/2004 Sjoberg et al.
2004/0206036 A1 10/2004 Pervan
2004/0211143 A1 10/2004 Hanning
2004/0211144 A1 10/2004 Stanchfield
2004/0219339 A1 11/2004 Dempsey et al.
2004/0241374 A1 12/2004 Thiers et al.
2004/0250492 A1 12/2004 Becker
2004/0255538 A1 12/2004 Ruhdorfer
2004/0255541 A1 12/2004 Thiers et al.
2004/0261348 A1 12/2004 Vulin
2005/0003160 A1 1/2005 Chen et al.
2005/0021081 A1 1/2005 Lebner
2005/0028474 A1 2/2005 Kim
2005/0050827 A1 3/2005 Schitter
2005/0055943 A1 3/2005 Pervan
2005/0112320 A1 5/2005 Wright
2005/0138881 A1 6/2005 Pervan
2005/0144881 A1 7/2005 Tate et al.
2005/0160694 A1 7/2005 Pervan
2005/0166502 A1 8/2005 Pervan et al.
2005/0166514 A1 8/2005 Pervan
2005/0166516 A1 8/2005 Pervan
2005/0176321 A1 8/2005 Crette et al.
2005/0193677 A1 9/2005 Vogel
2005/0208255 A1 9/2005 Pervan
2005/0210810 A1 9/2005 Pervan
2005/0221073 A1 10/2005 Liou
2005/0235593 A1 10/2005 Hecht
2005/0247000 A1 11/2005 Zhu
2005/0250921 A1 11/2005 Qiu et al.
2005/0252130 A1 11/2005 Martensson
2005/0268570 A2 12/2005 Pervan
2006/0010820 A1 1/2006 Schwitte et al.
2006/0032168 A1 2/2006 Fhiers et al.
2006/0032175 A1 2/2006 Chen et al.
2006/0048474 A1 3/2006 Pervan et al.
2006/0053724 A1 3/2006 Braun et al.
2006/0064940 A1 3/2006 Cappelle
2006/0070333 A1 4/2006 Pervan
2006/0075713 A1 4/2006 Pervan et al.
2006/0099386 A1 5/2006 Smith
2006/0101769 A1 5/2006 Pervan et al.
2006/0130416 A1 6/2006 Mohr et al.
2006/0144004 A1 7/2006 Nollet et al.
2006/0154015 A1 7/2006 Miller et al.
2006/0156666 A1 7/2006 Caufield
2006/0174974 A1 8/2006 Brannstrom et al.
2006/0196139 A1 9/2006 Pervan et al.
2006/0225377 A1 10/2006 Moriau et al.
2006/0236642 A1 10/2006 Pervan
2006/0248830 A1 11/2006 Gustaaf et al.
2006/0248831 A1 11/2006 Moriau et al.
2006/0260252 A1 11/2006 Brice
2006/0260254 A1 11/2006 Pervan
2006/0283127 A1 12/2006 Pervan
2007/0006543 A1 1/2007 Engstrom
2007/0011981 A1 1/2007 Eisermann
2007/0022694 A1 2/2007 Chen et al.
2007/0028547 A1 2/2007 Grafenauer et al.
2007/0094986 A1 5/2007 Moriau et al.
2007/0094987 A1 5/2007 Moriau et al.
2007/0130872 A1 6/2007 Goodwin et al.
2007/0151189 A1 7/2007 Yang
2007/0151191 A1 7/2007 August
2007/0154840 A1 7/2007 Thies et al.
2007/0166516 A1 7/2007 Kim et al.
2007/0175143 A1 8/2007 Pervan et al.
2007/0175144 A1 8/2007 Hakansson
2007/0175148 A1 8/2007 Bergelin et al.
2007/0175156 A1 8/2007 Pervan et al.
2007/0184230 A1 8/2007 Verrue et al.
2007/0193178 A1 8/2007 Groeke et al.
2007/0196624 A1 8/2007 Chen et al.
2007/0218252 A1 9/2007 Donald
2007/0275207 A1 11/2007 Higgins et al.
2008/0000179 A1 1/2008 Pervan et al.
2008/0000180 A1 1/2008 Pervan
2008/0000182 A1 1/2008 Pervan
2008/0000183 A1 1/2008 Bergelin et al.
2008/0000186 A1 1/2008 Pervan et al.
2008/0000187 A1 1/2008 Pervan
2008/0000188 A1 1/2008 Pervan
2008/0000189 A1 1/2008 Pervan et al.
2008/0000194 A1 1/2008 Pervan et al.
2008/0000417 A1 1/2008 Pervan et al.
2008/0005989 A1 1/2008 Pervan et al.
2008/0005992 A1 1/2008 Pervan
2008/0005997 A1 1/2008 Pervan
2008/0005998 A1 1/2008 Pervan
2008/0005999 A1 1/2008 Pervan
2008/0008871 A1 1/2008 Pervan
2008/0010931 A1 1/2008 Pervan et al.
2008/0010937 A1 1/2008 Pervan et al.
2008/0014161 A1 1/2008 Samain et al.
2008/0028707 A1 2/2008 Pervan
2008/0028713 A1 2/2008 Pervan et al.
2008/0029490 A1* 2/2008 Martin, Jr. ..... B29C 65/02 52/309.1
2008/0034701 A1 2/2008 Pervan
2008/0034708 A1 2/2008 Pervan
2008/0041007 A1 2/2008 Pervan et al.
2008/0041008 A1 2/2008 Pervan
2008/0053028 A1 3/2008 Moriau et al.
2008/0060308 A1 3/2008 Pervan
2008/0060309 A1 3/2008 Moriau et al.
2008/0060310 A1 3/2008 Moriau et al.
2008/0063844 A1 3/2008 Chen et al.
2008/0066415 A1 3/2008 Pervan et al.
2008/0092473 A1 4/2008 Heyns
2008/0104921 A1 5/2008 Pervan et al.
2008/0110125 A1 5/2008 Pervan
2008/0134607 A1 6/2008 Pervan et al.
2008/0134613 A1 6/2008 Pervan
2008/0134614 A1 6/2008 Pervan et al.
2008/0138560 A1 6/2008 Windmoller
2008/0141610 A1 6/2008 Thiers et al.
2008/0148674 A1 6/2008 Thiers et al.
2008/0153609 A1 6/2008 Kotler
2008/0172971 A1 7/2008 Pervan
2008/0184646 A1 8/2008 Alford et al.
2008/0241440 A1 10/2008 Bauer
2008/0256890 A1 10/2008 Pervan et al.
2008/0263975 A1 10/2008 Mead
2008/0311355 A1 12/2008 Chen et al.
2009/0019808 A1 1/2009 Palsson et al.
2009/0031662 A1 2/2009 Chen et al.
2009/0038253 A1 2/2009 Martensson
2009/0049787 A1 2/2009 Hannig
2009/0110888 A1 4/2009 Wuest et al.
2009/0133353 A1* 5/2009 Pervan ..... E04F 15/02033 52/747.1
2009/0151290 A1 6/2009 Liu
2009/0155612 A1 6/2009 Pervan et al.
2009/0159156 A1 6/2009 Walker
2009/0186710 A1 7/2009 Joseph
2009/0193748 A1 8/2009 Boo et al.
2009/0193753 A1 8/2009 Schitter
2009/0217611 A1 9/2009 Schrader
2009/0223162 A1 9/2009 Chen et al.

(56) References Cited

U.S. PATENT DOCUMENTS

| | | | |
|---|---|---|---|
| 2009/0226662 | A1 | 9/2009 | Dyczko-Riglin et al. |
| 2009/0235604 | A1 | 9/2009 | Cheng et al. |
| 2009/0249733 | A1 | 10/2009 | Moebus |
| 2009/0260313 | A1 | 10/2009 | Segaert |
| 2009/0272058 | A1 | 11/2009 | Duselis et al. |
| 2009/0320402 | A1 | 12/2009 | Schacht et al. |
| 2010/0011695 | A1 | 1/2010 | Cheng et al. |
| 2010/0018147 | A1 | 1/2010 | Du |
| 2010/0018149 | A1 | 1/2010 | Thiers |
| 2010/0031594 | A1 | 2/2010 | Liu et al. |
| 2010/0043333 | A1 | 2/2010 | Hannig |
| 2010/0058702 | A1 | 3/2010 | Lei |
| 2010/0242398 | A1 | 9/2010 | Cullen |
| 2010/0260962 | A1 | 10/2010 | Chen et al. |
| 2010/0293879 | A1 | 11/2010 | Pervan et al. |
| 2010/0300029 | A1 | 12/2010 | Braun et al. |
| 2010/0300030 | A1 | 12/2010 | Pervan et al. |
| 2010/0319293 | A1 | 12/2010 | Dammers |
| 2011/0001420 | A1 | 1/2011 | Tchakarov et al. |
| 2011/0008567 | A1 | 1/2011 | Weeks et al. |
| 2011/0030303 | A1 | 2/2011 | Pervan et al. |
| 2011/0041996 | A1 | 2/2011 | Pervan |
| 2011/0056167 | A1 | 3/2011 | Nilsson |
| 2011/0094178 | A1 | 4/2011 | Braun |
| 2011/0131901 | A1 | 6/2011 | Pervan et al. |
| 2011/0131909 | A1 | 6/2011 | Hannig |
| 2011/0138722 | A1 | 6/2011 | Hannig |
| 2011/0146177 | A1 | 6/2011 | Hannig |
| 2011/0154665 | A1 | 6/2011 | Pervan et al. |
| 2011/0154763 | A1 | 6/2011 | Bergelin et al. |
| 2011/0167744 | A1 | 7/2011 | Whispell et al. |
| 2011/0167751 | A1 | 7/2011 | Engstrom |
| 2011/0173914 | A1 | 7/2011 | Engstrom |
| 2011/0247285 | A1 | 10/2011 | Wybo et al. |
| 2011/0247748 | A1 | 10/2011 | Pervan et al. |
| 2011/0258959 | A1 | 10/2011 | Braun |
| 2011/0296780 | A1 | 12/2011 | Windmoeller |
| 2012/0003439 | A1 | 1/2012 | Chen et al. |
| 2012/0017534 | A1 | 1/2012 | Oh |
| 2012/0040149 | A1 | 2/2012 | Chen et al. |
| 2012/0067461 | A1 | 3/2012 | Braun |
| 2012/0124932 | A1 | 5/2012 | Schulte et al. |
| 2012/0137617 | A1 | 6/2012 | Pervan |
| 2012/0180416 | A1 | 7/2012 | Perra et al. |
| 2012/0216472 | A1 | 8/2012 | Martensson et al. |
| 2012/0266555 | A1 | 10/2012 | Cappelle |
| 2012/0276369 | A1 | 11/2012 | Jing et al. |
| 2012/0279154 | A1 | 11/2012 | Bergelin et al. |
| 2013/0014890 | A1 | 1/2013 | Pervan et al. |
| 2013/0042563 | A1 | 2/2013 | Pervan et al. |
| 2013/0042565 | A1 | 2/2013 | Pervan et al. |
| 2013/0047536 | A1 | 2/2013 | Pervan |
| 2013/0111758 | A1 | 5/2013 | Nilsson et al. |
| 2013/0160391 | A1 | 6/2013 | Pervan et al. |
| 2013/0269863 | A1 | 10/2013 | Pervan et al. |
| 2013/0298487 | A1 | 11/2013 | Bergelin et al. |
| 2013/0305649 | A1 | 11/2013 | Thiers |
| 2013/0333182 | A1 | 12/2013 | Pervan et al. |
| 2014/0007539 | A1 | 1/2014 | Pervan et al. |
| 2014/0033633 | A1 | 2/2014 | Kell |
| 2014/0033635 | A1 | 2/2014 | Pervan et al. |
| 2014/0069043 | A1 | 3/2014 | Pervan |
| 2014/0069044 | A1 | 3/2014 | Wallin |
| 2014/0090331 | A1 | 4/2014 | Pervan et al. |
| 2014/0115994 | A1 | 5/2014 | Pervan et al. |
| 2014/0237924 | A1 | 8/2014 | Nilsson et al. |
| 2014/0283466 | A1 | 9/2014 | Boo |
| 2014/0318061 | A1 | 10/2014 | Pervan |
| 2014/0352248 | A1 | 12/2014 | Whispell et al. |
| 2014/0356594 | A1 | 12/2014 | Chen et al. |
| 2014/0366476 | A1 | 12/2014 | Pervan et al. |
| 2014/0366477 | A1 | 12/2014 | Kell |
| 2015/0225964 | A1 | 8/2015 | Chen et al. |
| 2015/0330088 | A1 | 11/2015 | Derelov |
| 2015/0368910 | A1 | 12/2015 | Kell |
| 2016/0016390 | A1 | 1/2016 | Lundblad et al. |
| 2016/0016391 | A1 | 1/2016 | Lundblad et al. |
| 2016/0047129 | A1 | 2/2016 | Bowers |
| 2016/0052245 | A1 | 2/2016 | Chen et al. |
| 2016/0069089 | A1 | 3/2016 | Bergelin et al. |
| 2016/0076260 | A1 | 3/2016 | Pervan et al. |
| 2016/0108624 | A1 | 4/2016 | Nilsson et al. |
| 2016/0186318 | A1 | 6/2016 | Pervan et al. |
| 2016/0194883 | A1 | 7/2016 | Pervan |
| 2016/0194885 | A1 | 7/2016 | Whispell et al. |
| 2016/0201324 | A1 | 7/2016 | Hkansson et al. |
| 2016/0265234 | A1 | 9/2016 | Pervan |
| 2017/0030088 | A1 | 2/2017 | Simoens |
| 2017/0037642 | A1 | 2/2017 | Christian |
| 2017/0037645 | A1 | 2/2017 | Pervan |
| 2017/0175400 | A1 | 6/2017 | Josefsson et al. |
| 2017/0241136 | A1 | 8/2017 | Kell |
| 2017/0350140 | A1 | 12/2017 | Bergelin et al. |
| 2017/0362834 | A1 | 12/2017 | Pervan et al. |
| 2018/0094441 | A1 | 4/2018 | Boo |
| 2018/0313093 | A1 | 11/2018 | Nilsson et al. |
| 2019/0017278 | A1 | 1/2019 | De et al. |
| 2019/0091977 | A1 | 3/2019 | Lundblad et al. |
| 2019/0211569 | A1 | 7/2019 | Boo et al. |
| 2019/0249444 | A1 | 8/2019 | Kell |
| 2019/0277041 | A1 | 9/2019 | Pervan et al. |
| 2019/0394314 | A1 | 12/2019 | Pervan et al. |
| 2020/0056379 | A1 | 2/2020 | Boo |
| 2020/0063441 | A1 | 2/2020 | Boo |
| 2020/0180282 | A1 | 6/2020 | Lundblad et al. |
| 2020/0208409 | A1 | 7/2020 | Kell |
| 2020/0248462 | A1 | 8/2020 | Bergelin et al. |
| 2020/0407981 | A1 | 12/2020 | Boo et al. |
| 2020/0412852 | A9 | 12/2020 | Pervan et al. |
| 2021/0053322 | A1 | 2/2021 | Lundblad et al. |
| 2021/0115680 | A1 | 4/2021 | Whispell et al. |
| 2021/0207385 | A1 | 7/2021 | Boo |
| 2021/0214953 | A1 | 7/2021 | Kell |
| 2021/0230881 | A1 | 7/2021 | Boo |

FOREIGN PATENT DOCUMENTS

| | | | |
|---|---|---|---|
| CA | 2252791 | A1 | 5/1999 |
| CA | 2456513 | A1 | 2/2003 |
| CN | 2076142 | U | 5/1991 |
| CN | 2106197 | U | 6/1992 |
| CN | 2124276 | U | 12/1992 |
| CN | 2272915 | Y | 1/1998 |
| CN | 2301491 | Y | 12/1998 |
| CN | 1270263 | A | 10/2000 |
| CN | 101492950 | A | 7/2009 |
| DE | 1081653 | B | 5/1960 |
| DE | 1534802 | A1 | 4/1970 |
| DE | 2251762 | A1 | 5/1974 |
| DE | 2824656 | A1 | 1/1979 |
| DE | 0134967 | A1 | 4/1979 |
| DE | 2832817 | A1 | 2/1980 |
| DE | 3150352 | A1 | 10/1982 |
| DE | 3135716 | A1 | 6/1983 |
| DE | 3343601 | A1 | 6/1985 |
| DE | 3538538 | A1 | 5/1987 |
| DE | 3904686 | C1 | 8/1989 |
| DE | 3932980 | A1 | 11/1991 |
| DE | 4020682 | A1 | 1/1992 |
| DE | 4242530 | A1 | 6/1994 |
| DE | 29517995 | U1 | 2/1996 |
| DE | 19854475 | A1 | 7/1999 |
| DE | 29908733 | U1 | 8/1999 |
| DE | 29823681 | U1 | 11/1999 |
| DE | 20002744 | U1 | 8/2000 |
| DE | 20008708 | U1 | 9/2000 |
| DE | 20018817 | U1 | 1/2001 |
| DE | 19944399 | A1 | 4/2001 |
| DE | 10001248 | A1 | 7/2001 |
| DE | 10032204 | C1 | 7/2001 |
| DE | 10006748 | A1 | 8/2001 |
| DE | 20206460 | U1 | 7/2002 |
| DE | 20207844 | U1 | 8/2002 |
| DE | 20214532 | U1 | 2/2004 |

(56) References Cited

FOREIGN PATENT DOCUMENTS

| | | | |
|---|---|---|---|
| DE | 10316695 | A1 | 10/2004 |
| DE | 10316886 | A1 | 10/2004 |
| DE | 202004014160 | U1 | 11/2004 |
| DE | 202005004537 | U1 | 6/2005 |
| DE | 102004001363 | A1 | 8/2005 |
| DE | 102004011531 | B3 | 11/2005 |
| DE | 102005023661 | A1 | 11/2006 |
| DE | 102005024366 | A1 | 11/2006 |
| DE | 102005061099 | A1 | 3/2007 |
| DE | 102006024184 | A1 | 11/2007 |
| DE | 102006058655 | A1 | 6/2008 |
| DE | 202008011589 | U1 | 11/2008 |
| DE | 202008012001 | U1 | 11/2008 |
| DE | 202016102034 | U1 | 5/2016 |
| EP | 0665347 | A1 | 8/1955 |
| EP | 0046526 | A2 | 3/1982 |
| EP | 0562402 | A1 | 9/1993 |
| EP | 0698126 | A1 | 2/1996 |
| EP | 0890373 | A1 | 1/1999 |
| EP | 0903451 | A2 | 3/1999 |
| EP | 1024234 | A2 | 8/2000 |
| EP | 1036341 | A1 | 9/2000 |
| EP | 1045083 | A1 | 10/2000 |
| EP | 1061201 | A2 | 12/2000 |
| EP | 1165906 | A1 | 1/2002 |
| EP | 1262607 | A1 | 12/2002 |
| EP | 1262609 | A1 | 12/2002 |
| EP | 1308577 | A2 | 5/2003 |
| EP | 1350904 | A2 | 10/2003 |
| EP | 1357239 | A2 | 10/2003 |
| EP | 1357904 | A2 | 11/2003 |
| EP | 1362947 | A2 | 11/2003 |
| EP | 1396593 | A2 | 3/2004 |
| EP | 1420125 | A2 | 5/2004 |
| EP | 1437457 | A2 | 7/2004 |
| EP | 1512808 | A1 | 3/2005 |
| EP | 1570143 | A1 | 9/2005 |
| EP | 1585875 | A1 | 10/2005 |
| EP | 1640530 | A2 | 3/2006 |
| EP | 0843763 | B2 | 11/2006 |
| EP | 1938963 | A1 | 7/2008 |
| EP | 2009197 | A1 | 12/2008 |
| EP | 2339092 | A1 | 6/2011 |
| EP | 2189591 | A3 | 3/2012 |
| EP | 2516768 | A2 | 10/2012 |
| ES | 2327502 | T3 | 10/2009 |
| FR | 1293043 | A | 5/1962 |
| FR | 2278876 | A1 | 2/1976 |
| FR | 2445875 | A1 | 8/1980 |
| FR | 2498666 | A1 | 7/1982 |
| FR | 2557905 | A1 | 7/1985 |
| FR | 2810060 | A1 | 12/2001 |
| GB | 190625180 | A | 7/1907 |
| GB | 0484750 | A | 5/1938 |
| GB | 0875327 | A | 8/1961 |
| GB | 0900958 | A | 7/1962 |
| GB | 1189485 | A | 4/1970 |
| GB | 1308011 | A | 2/1973 |
| GB | 1430423 | A | 3/1976 |
| GB | 1520964 | A | 8/1978 |
| GB | 2020998 | A | 11/1979 |
| GB | 2095814 | A | 10/1982 |
| GB | 2117813 | A | 10/1983 |
| GB | 2145371 | A | 3/1985 |
| GB | 2147856 | A | 5/1985 |
| GB | 2243381 | A | 10/1991 |
| GB | 2256023 | A | 11/1992 |
| JP | 56-104936 | U | 8/1981 |
| JP | 56-131752 | A | 10/1981 |
| JP | 57-119056 | A | 7/1982 |
| JP | 57-157636 | U | 10/1982 |
| JP | 59-185346 | U | 12/1984 |
| JP | 60-255843 | A | 12/1985 |
| JP | 62-127225 | A | 6/1987 |
| JP | 01-178659 | A | 7/1989 |
| JP | 01-202403 | A | 8/1989 |
| JP | 01-033702 | Y2 | 10/1989 |
| JP | 03-169967 | A | 7/1991 |
| JP | 05-169534 | A | 7/1993 |
| JP | 05-096282 | U | 12/1993 |
| JP | 05-318674 | A | 12/1993 |
| JP | 06-064108 | A | 3/1994 |
| JP | 06-039840 | B2 | 5/1994 |
| JP | 06-315944 | A | 11/1994 |
| JP | 07-026467 | U | 5/1995 |
| JP | 07-180333 | A | 7/1995 |
| JP | 07-300979 | A | 11/1995 |
| JP | 08-074405 | A | 3/1996 |
| JP | 08-086080 | A | 4/1996 |
| JP | 08-109734 | A | 4/1996 |
| JP | 09-053319 | A | 2/1997 |
| JP | 09-254697 | A | 9/1997 |
| JP | 10-002096 | A | 1/1998 |
| JP | 10-219975 | A | 8/1998 |
| JP | 11-131771 | A | 5/1999 |
| JP | 11-268010 | A | 10/1999 |
| JP | 2002-011708 | A | 1/2002 |
| JP | 3363976 | B2 | 1/2003 |
| KR | 10-1996-0005785 | A | 2/1996 |
| KR | 10-2007-0000322 | A | 1/2007 |
| KR | 10-2008-0096189 | A | 10/2008 |
| KR | 10-0870496 | B1 | 11/2008 |
| NO | 90/06232 | A1 | 6/1990 |
| SE | 506254 | C2 | 11/1997 |
| SE | 0000785 | L | 9/2001 |
| SE | 0103130 | L | 3/2003 |
| WO | 89/03753 | A1 | 5/1989 |
| WO | 94/01628 | A2 | 1/1994 |
| WO | 94/26999 | A1 | 11/1994 |
| WO | 94/28183 | A1 | 12/1994 |
| WO | 95/11333 | A1 | 4/1995 |
| WO | 96/07801 | A1 | 3/1996 |
| WO | 96/09262 | A2 | 3/1996 |
| WO | 96/27721 | A1 | 9/1996 |
| WO | 97/10396 | A1 | 3/1997 |
| WO | 97/18949 | A1 | 5/1997 |
| WO | 97/21011 | A2 | 6/1997 |
| WO | 97/47834 | A1 | 12/1997 |
| WO | 98/38401 | A1 | 9/1998 |
| WO | 98/58142 | A1 | 12/1998 |
| WO | 99/17930 | A1 | 4/1999 |
| WO | 99/28767 | A1 | 6/1999 |
| WO | 99/58254 | A1 | 11/1999 |
| WO | 99/66151 | A1 | 12/1999 |
| WO | 99/66152 | A1 | 12/1999 |
| WO | 00/17467 | A1 | 3/2000 |
| WO | 00/20705 | A1 | 4/2000 |
| WO | 00/22225 | A1 | 4/2000 |
| WO | 00/44984 | A1 | 8/2000 |
| WO | 00/47841 | A1 | 8/2000 |
| WO | 00/66856 | A1 | 11/2000 |
| WO | 01/02669 | A1 | 1/2001 |
| WO | 01/02670 | A1 | 1/2001 |
| WO | 01/02671 | A1 | 1/2001 |
| WO | 01/44669 | A2 | 6/2001 |
| WO | 01/47726 | A1 | 7/2001 |
| WO | 01/48331 | A1 | 7/2001 |
| WO | 01/48332 | A1 | 7/2001 |
| WO | 01/48333 | A1 | 7/2001 |
| WO | 01/51732 | A1 | 7/2001 |
| WO | 01/51733 | A1 | 7/2001 |
| WO | 01/53628 | A1 | 7/2001 |
| WO | 01/66877 | A1 | 9/2001 |
| WO | 01/75247 | A1 | 10/2001 |
| WO | 01/77461 | A1 | 10/2001 |
| WO | 01/88306 | A1 | 11/2001 |
| WO | 01/98604 | A1 | 12/2001 |
| WO | 02/41880 | A2 | 5/2002 |
| WO | 02/55809 | A1 | 7/2002 |
| WO | 02/55810 | A1 | 7/2002 |
| WO | 02/60691 | A1 | 8/2002 |
| WO | 02/92342 | A1 | 11/2002 |
| WO | 2002/103135 | A1 | 12/2002 |
| WO | 03/12224 | A1 | 2/2003 |

(56) References Cited

FOREIGN PATENT DOCUMENTS

| | | | |
|---|---|---|---|
| WO | 03/16654 | A1 | 2/2003 |
| WO | 03/25307 | A1 | 3/2003 |
| WO | 03/35396 | A1 | 5/2003 |
| WO | 03/38210 | A1 | 5/2003 |
| WO | 03/44303 | A1 | 5/2003 |
| WO | 03/78761 | A1 | 9/2003 |
| WO | 03/83234 | A1 | 10/2003 |
| WO | 03/85222 | A1 | 10/2003 |
| WO | 03/89736 | A1 | 10/2003 |
| WO | 2004/005648 | A1 | 1/2004 |
| WO | 2004/011740 | A2 | 2/2004 |
| WO | 2004/016876 | A2 | 2/2004 |
| WO | 2004/016877 | A1 | 2/2004 |
| WO | 2004/044348 | A1 | 5/2004 |
| WO | 2004/050780 | A2 | 6/2004 |
| WO | 2004/052357 | A1 | 6/2004 |
| WO | 2004/053256 | A1 | 6/2004 |
| WO | 2004/053257 | A1 | 6/2004 |
| WO | 2004/079130 | A1 | 9/2004 |
| WO | 2004/085765 | A1 | 10/2004 |
| WO | 2005/068747 | A1 | 7/2005 |
| WO | 2005/088029 | A1 | 9/2005 |
| WO | 2005/098163 | A1 | 10/2005 |
| WO | 2006/032378 | A1 | 3/2006 |
| WO | 2006/043893 | A1 | 4/2006 |
| WO | 2006/104436 | A1 | 10/2006 |
| WO | 2006/123988 | A1 | 11/2006 |
| WO | 2006/126930 | A1 | 11/2006 |
| WO | 2006/133690 | A1 | 12/2006 |
| WO | 2007/015669 | A2 | 2/2007 |
| WO | 2007/016978 | A1 | 2/2007 |
| WO | 2007/020088 | A1 | 2/2007 |
| WO | 2007/079845 | A1 | 7/2007 |
| WO | 2007/081267 | A1 | 7/2007 |
| WO | 2007/089186 | A1 | 8/2007 |
| WO | 2007/118351 | A1 | 10/2007 |
| WO | 2007/118352 | A1 | 10/2007 |
| WO | 2008/004960 | A2 | 1/2008 |
| WO | 2008/008016 | A1 | 1/2008 |
| WO | 2008/008824 | A1 | 1/2008 |
| WO | 2008/017281 | A1 | 2/2008 |
| WO | 2008/017301 | A2 | 2/2008 |
| WO | 2008/068245 | A1 | 6/2008 |
| WO | 2008/116623 | A1 | 10/2008 |
| WO | 2008/133377 | A1 | 11/2008 |
| WO | 2008/142538 | A2 | 11/2008 |
| WO | 2009/033623 | A1 | 3/2009 |
| WO | 2009/061279 | A1 | 5/2009 |
| WO | 2009/071822 | A2 | 6/2009 |
| WO | 2009/116926 | A1 | 9/2009 |
| WO | 2010/015516 | A2 | 2/2010 |
| WO | 2010/023042 | A1 | 3/2010 |
| WO | 2010/028901 | A1 | 3/2010 |
| WO | 2010/072357 | A2 | 7/2010 |
| WO | 2010/081532 | A1 | 7/2010 |
| WO | 2010/086084 | A1 | 8/2010 |
| WO | 2010/087752 | A1 | 8/2010 |
| WO | 2010/114236 | A2 | 10/2010 |
| WO | 2010/128043 | A1 | 11/2010 |
| WO | 2011/012104 | A2 | 2/2011 |
| WO | 2011/028171 | A1 | 3/2011 |
| WO | 2011/077311 | A2 | 6/2011 |
| WO | 2012/126046 | A1 | 9/2012 |

OTHER PUBLICATIONS

Communication Pursuant to Article 94(3) EPC dated Oct. 13, 2017 in EP Patent Application No. 14 794 996.0, EPO, Munich, DE, 9 pages.

Communication from European Patent Office dated Oct. 29, 2013 with Letter from Opponent dated Oct. 24, 2013 in related European Patent No. 1108529 (EP Patent Application No. 00127179.0) (11 pages).

Complaint, *Valinge Innovation AB* v. *Halstead New England Corp. and The Home Depot, Inc.*, United States District Court for the District of Delaware, Case No. 1-16-cv-01082, dated Nov. 23, 2016, 14 pages.

Composite Panel Report: Laminate Flooring, Wood Diciest, Sep. 1999, p. 37, Cygnus Publishing, Inc., & Affiliates, Fort Atkinson, WI, 6 pages.

Declaration of Brian A. Biggs in Support of Defendants Halstead New England Corp, and Home Depot U.S.A., Inc.'s Responsive Claim Construction Brief, with Exhibit 1, *Valinge Innovation AB* v. *Halstead New England Corp, and Home Depot U.S.A., Inc.*, United States District Court for the District of Delaware, C.A. No. 16-1082-LPS-CJB, dated Jan. 16, 2018, 6 pages (Document 103, 103-1, 103-2).

Declaration of Pilar G. Kraman in Support of Plaintiff's Opening Claim Construction Brief, with Exhibits 1-6, *Valinge Innovation AB* v. *Halstead New England Corp. and Home Depot U.S.A., Inc.*, United States District Court for the District of Delaware, C.A. No. 16-1082-LPS-CJB, dated Dec. 11, 2017, 65 pages (Document 87, 87-1, 87-2).

Declaration of Pilar G. Kraman in Support of Plaintiff's Responsive Claim Construction Brief, with Exhibits 1-15, *Valinge Innovation AB* v. *Halstead New England Corp. and Home Depot U.S.A., Inc.*, United States District Court for the District of Delaware, C.A. No. 16-1082-LPS-CJB, dated Jan. 16, 2018, 105 pages (Document 99, 99-1).

Declaration of Richard T. Kaczkowski, with Exhibits A-D, *Valinge Innovation AB* v. *Halstead New England Corp. and Home Depot U.S.A., Inc.*, United States District Court for the District of Delaware, C.A. No. 16-1082-LPS-CJB, dated Dec. 11, 2017, 48 pages (Document 91, 91-1).

Declaration of Robert M Kimmel, Sc.D. on Claim Construction, with Exhibits A-Q, *Valinge Innovation AB* v. *Halstead New England Corp. and Home Depot U.S.A., Inc.*, United States District Court for the District of Delaware, C.A. No. 16-1082-LPS-CJB, dated Dec. 11, 2017, 153 pages (Document 90, 90-1, 90-2).

Declaration of Steven B. MacLean in Support of Plaintiff's Opening Claim Construction Brief, with Exhibits 1-2, *Valinge Innovation AB* v. *Halstead New England Corp. and Home Depot U.S.A., Inc.*, United States District Court for the District of Delaware, C.A. No. 16-1082-LPS-CJB, dated Dec. 11, 2017, 23 pages. (Document 88, 88-1. 88-2).

Declaration of Steven B. MacLean in Support of Plaintiff's Responsive Claim Construction Brief, *Valinge Innovation AB* v. *Halstead New England Corp. and Home Depot U.S.A., Inc.*, United States District Court for the District of Delaware, C.A. No. 16-1082-LPS-CJB, dated Jan. 16, 2018, 25 pages (Document 100).

Defendant Halstead New England Corp.'s Answer to the Third Amended Complaint, Affirmative Defenses and Counterclaim—*Valinge Innovation AB* v. *Halstead New England Corp. and Home Depot U.S.A., Inc.*, United States District Court for the District of Delaware, C.A. No. 16-1082-LPS-CJB, dated Aug. 8, 2018, 172 pages (Document 242, 242-1, 242-2, 242-3—Redacted Version of Document 230).

Defendants Halstead New England Corp. and Home Depot U.S.A., Inc.'s Opening Claim Construction Brief, *Valinge Innovation AB* v. *Halstead New England Corp. and Home Depot U.S.A., Inc.*, United States District Court for the District of Delaware, C.A. No. 16-1082-LPS-CJB, dated Dec. 11, 2017, 36 pages. (Document 89).

Defendants Halstead New England Corp. and Home Depot U.S.A., Inc.'s Responsive Claim Construction Brief, *Valinge Innovation AB* v. *Halstead New England Corp. and Home Depot U.S.A., Inc.*, United States District Court for the District of Delaware, C.A. No. 16-1082-LPS-CJB, dated Jan. 16, 2018, 26 pages (Document 102, 102-1).

Engstrand, Ola (Contact)/Valinge Innovation AB, Technical Disclosure entitled "VA-038 Mechanical Locking of Floor Panels With Vertical Folding," IP com No. IPCOM000179246D, Feb. 10, 2009, IP.com Prior Art Database, 59 pages.

European Search Report in EP 1 108 529, dated Apr. 17, 2002 (dated Mar. 6, 2002), The Hague, NL, 3 pages.

Excerpt from Bodenwanddecke, "USA: Das sind die Trends," Apr. 2000, p. 7.

(56) References Cited

OTHER PUBLICATIONS

Exhibits 1-17 (re Document 89), *Valinge Innovation AB* v. *Halstead New England Corp. and Home Depot U.S.A., Inc*., United States District Court for the District of Delaware, C.A. No. 16-1082-LPS-CJB, dated Dec. 11, 2017, 381 pages (Document 92, 92-1).
Extended European Search Report issued in EP 10814032.8, dated Aug. 2, 2017, European Patent Office, Munich, DE, 9 pages.
Extended European Search Report issued in EP 19168204.6, dated Aug. 1, 2019, European Patent Office, Munich, DE, 9 pages.
International Search Report issued in PCT/SE2010/050941, dated Nov. 1, 2010, Patent-och registreringsverket, Stockholm, SE, 5 pages.
Joint Motion for Entry of Partial Summary Judgment—*Valinge Innovation AB* v. *Halstead New England Corp. and Home Depot U.S.A., Inc*., United States District Court for the District of Delaware, C.A. No. 16-1082-LPS-CJB, dated Sep. 13, 2018, 4 pages (Document 262).
Laminatfu boden, Technik and Technologien, Laminatforum, 1999, pp. 23-24.
Lowe's, How to Install a Laminate Floor, YouTube video available for viewing at https://youtu.be/zhlXVHAejlk?t=3m52s, Oct. 2008 (last accessed Feb. 15, 2018).
Memorandum Opinion, *Valinge Innovation AB* v. *Halstead New England Corp. and Home Depot U.S.A., Inc*., United States District Court for the District of Delaware, C.A. No. 16-1082-LPS-CJB, dated May 7, 2018, 19 pages (Document 162).
Mobil oil/Holzwerkstoff—Symposium, Stuttgart 1998, Volker Kettler, Witex AG, pp. 1-24.
Notice of Opposition to a European Patent dated Feb. 29, 2012, filed with the European Patent Office in related European Patent No. 1108529 (EP Patent Application No. 00127179.0) (23 pages).
Notice of Opposition to a European Patent dated Nov. 6, 2013, filed with the European Patent Office in related European Patent No. 2248665 (EP Patent Application No. 10007691.8) (22 pages).
Official Communication form European Patent Office for EP 00 127 179.0 dated Mar. 21, 2007, 4 pages.
Order of Partial Summary Judgment—*Valinge Innovation AB* v. *Halstead New England Corp. and Home Depot U.S.A., Inc*., United States District Court for the District of Delaware, C.A. No. 16-1082-LPS-CJB, dated Sep. 13, 2018, 2 pages (Document 262-1).
Order, *Valinge Innovation Ab* v. *Halstead New England Corp. and Home Depot U.S.A., Inc*., United States District Court for the District of Delaware, C.A. No. 16/1082-Lps-Cjb, dated May 7, 2018, 2 pp. (Document 163).
Pervan, Darko (Author), Technical Disclosure entitled "VA073a Zip Loc," IP com No. IPCOM000210869D, Sep. 13, 2011, IP.com Prior Art Database, 36 pages.
Plaintiff's Opening Claim Construction Brief, *Valinge Innovation AB* v. *Halstead New England Corp. and Home Depot U.S.A., Inc*., United States District Court for the District of Delaware, C.A. No. 16-1082-LPS-CJB, dated Dec. 11, 2017, 38 pages (Document 86).
Plaintiff's Responsive Claim Construction Brief, *Valinge Innovation AB* v. *Halstead New England Corp. and Home Depot U.S.A., Inc*., United States District Court for the District of Delaware, C.A. No. 16-1082-LPS-CJB, dated Jan. 16, 2018, 29 pages (Document 98).
Plasticizer, dated Feb. 29, 2012, from Wikipedia (6 pages).
PVC Resin—Solution Viscosity—K Value Chart, Plastemart, (1 page).
Reference: Polymer Properties, Polymer Products from Aldrich, dated 1993, (2 pages).
Second Amended Complaint, *Valinge Innovation AB* v. *Halstead New England Corp., Halstead International; Home Depot U.S.A., Inc.; and The Home Depot, Inc*., United States District Court for the District of Delaware, Case No. 16-1082-LPS-CJB, dated Mar. 28, 2017, 55 pages.
Soine, H., Holzwerkstoffe, Herstellung und Verarbeitung; Platten, Beschichtungsstoffe, Formteile, TUren, Mabel; Von Hansgert Soine; DRW-Verlag, 1995 (51 pages).
Summons to attend oral proceedings pursuant to Rule 115(1) EPC from European Patent Office dated Nov. 5, 2013 in related European patent No. 1108529 (EP Patent Application No. 00127179.0 (13 pages).
Supplemental Declaration of Robert M. Kimmel, Sc.D. on Claim Construction, with Exhibits A-J, *Valinge Innovation AB* v. *Halstead New England Corp. and Home Depot U.S.A., Inc*., United States District Court for the District of Delaware, C.A. No. 16-1082-LPS-CJB, dated Jan. 16, 2018, 69 pages (Document 104, 104-1, 104-2).
Third Amended Complaint, *Valinge Innovation AB* v. *Halstead New England Corp. and Home Depot U.S.A., Inc*., United States District Court for the District of Delaware, C.A. No. 16-1082-LPS-CJB, dated Jul. 10, 2018, 69 pages (Document 214).
Ullmann's Encyclopedia of Industrial Chemistry, "Wood", 1996, vol. A28, 9 pages incl pp. 345-350. VCH Vertagsgesellschaft mbH, VCH Publishers, NY, NY.
Vaiinge Innovation AB, Technical Disclosure entitled "Mechanical locking for floor panels with a flexible bristle tongue," IP.com No. IPCOM000145262D, Jan. 12, 2007, IP.com PriorArtDatabase, 57 pages.
Wikes, et al., "Table 5.3 Typical properties of General Purpose Vinyl Plastic Products," PVC Handbook, ISBN 3-446-22714-8, 1988, p. 184.

* cited by examiner

RESILIENT FLOOR

CROSS-REFERENCE TO RELATED APPLICATIONS

This application is a continuation of U.S. application Ser. No. 16/713,431, filed on Dec. 13, 2019, which is a continuation of U.S. application Ser. No. 16/027,465, filed on Jul. 5, 2018, now U.S. Pat. No. 10,526,793, which is a continuation of U.S. application Ser. No. 14/982,608, filed on Dec. 29, 2015, now U.S. Pat. No. 10,047,527, which is a continuation of U.S. application Ser. No. 14/272,895, filed on May 8, 2014, now U.S. Pat. No. 9,249,581, which is a continuation of U.S. application Ser. No. 13/734,406, filed on Jan. 4, 2013, now U.S. Pat. No. 8,756,899, which is a continuation of U.S. application Ser. No. 12/875,293, filed on Sep. 3, 2010, now U.S. Pat. No. 8,365,499, which claims benefit to U.S. Provisional Application No. 61/239,927, filed Sep. 4, 2009. The entire contents of U.S. application Ser. No. 16/713,431, U.S. application Ser. No. 16/027,465, U.S. application Ser. No. 14/982,608, U.S. application Ser. No. 14/272,895, U.S. application Ser. No. 13/734,406, U.S. application Ser. No. 12/875,293 and U.S. Provisional Application No. 61/239,927 are each hereby incorporated by reference in its entirety.

TECHNICAL FIELD

The present invention generally concerns a method of assembling of floorboards provided with a mechanical locking system.

BACKGROUND OF THE INVENTION

Floorboards with a wood based core that are provided with a mechanical locking system and methods of assembling such floorboards by angling-angling, angling-snapping or vertical folding are disclosed in e.g. WO 94/26999, WO 01/77461, WO 2006/043893 land WO 01/75247. Floorboards of resilient material, e.g. PVC, are known, commonly referred to as LVT (Luxury Vinyl Tiles) that are glued down to the subfloor or bonded at the edges to each other WO 2008/008824.

SUMMARY OF THE INVENTION

A method is disclosed for assembling of floorboards, which are so called resilient floorboards i.e. the core is of a resilient material for example vinyl or PVC. The known methods of assembling floorboards that are mentioned above are difficult to use when assembling resilient floorboards since resilient floorboards easily bend which make it hard to use the angling-angling method and it is unfeasible to use the angling-snapping method since it requires a force to be applied, at an opposite edge in relation to the edge of the floorboard which is intended to be connected, by e.g. a hammer and a tapping block and the resilient core of the resilient floorboard absorbs the applied force. The known vertical folding methods are also difficult to apply due to the increased friction in the resilient material. The disclosed method makes the assembling easier and reduces the force needed for connection of the floorboards.

Furthermore, a locking system suitable for the method is disclosed. The locking system decreases the friction forces that must be overcome when installing the resilient floorboards.

An aspect of the invention is a method of assembling resilient floorboards, which are provided with a mechanical locking system, which method comprises the step of:

positioning a floorboard edge, provided with a first device of said mechanical locking system (11), juxtaposed another floorboard edge, provided with a second device of said mechanical locking system (11);

bending (30) the floorboard (2) along the edge; and applying a force (F) on a first part of the floorboard edge, wherein at said first part of the floorboard edge said first device is pushed into said second device to obtain a vertical and horizontal mechanical locking of a part of the floorboards' edges.

The bending makes it possible to finalize the connection of only a part of the edge of the floorboard, instead of the whole edge as in the known methods, and consequently the force needed to assemble the floorboards is considerably reduced.

The bending is preferably achieved by raising an outer part of said edge preferably by positioning of a raising device, e.g. a wedge, or a hand/finger of the assembler under said floorboard. The raised position of the outer part of said edge is preferably maintained during the force-applying step. In a preferred embodiment also the position of the raising device is maintained during the force-applying step.

The method comprises thereafter preferably the step of applying a force to a new part of the edge, which new part is adjacent to the mechanically locked part, and repeating this step until the whole edge is connected to said another edge.

The force is preferably applied by a tool and most preferably by a tool with a rotatable part.

In a preferred embodiment, the first device is an upper locking strip, which is resiliently bendable, with a downwardly protruding locking element and the second device is a lower locking strip provided with an upwardly protruding locking element. The resiliently bendable locking strip facilitates the connection of the floorboards. The downwardly protruding locking element is provided with a locking surface, which cooperates, for horizontal locking, with a locking surface of the upwardly protruding locking element. The locking strips are integrally formed with the resilient floorboards and preferably of the same resilient material. The downwardly and/or the upwardly protruding locking element is preferably provided with a guiding surface which are configured to guide the locking elements in to a position where the floorboards are connected by the locking elements and the locking surfaces cooperate.

The resilient floorboards are in a preferred embodiment made of a bendable thermo plastic, e.g. vinyl, surlyn, and PVC. Floorboards of vinyl are generally referred to as LVT (Luxury Vinyl Tiles). In a most preferred embodiment the thickness of the floorboard is about 4 mm to about 10 mm. If the floorboards are too thin it is hard to produce a locking system integrally in the floorboard material and if they are too thick it is hard to assemble the floorboards with the disclosed method.

The floorboards are in a preferred embodiment provided with an upper decorative layer made of a similar resilient material and most preferably provided with a balancing layer and/or a sublayer.

The force is preferably applied with a tool, which comprises a handle and a press part for applying a force on the floorboard. Preferably, the press part is provided with an outer round or circular shape for applying the force on the floorboard and in the most preferred embodiment the press part is rotatable.

DETAILED DESCRIPTION OF EMBODIMENTS

Figure 1A:
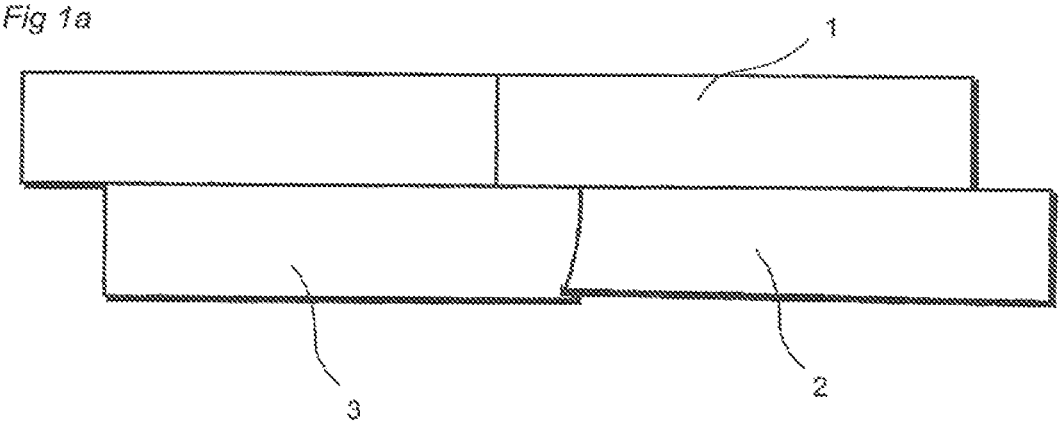
FIGS. 1*a*-1*b* show an embodiment of the assembling method.
Figure 1B:
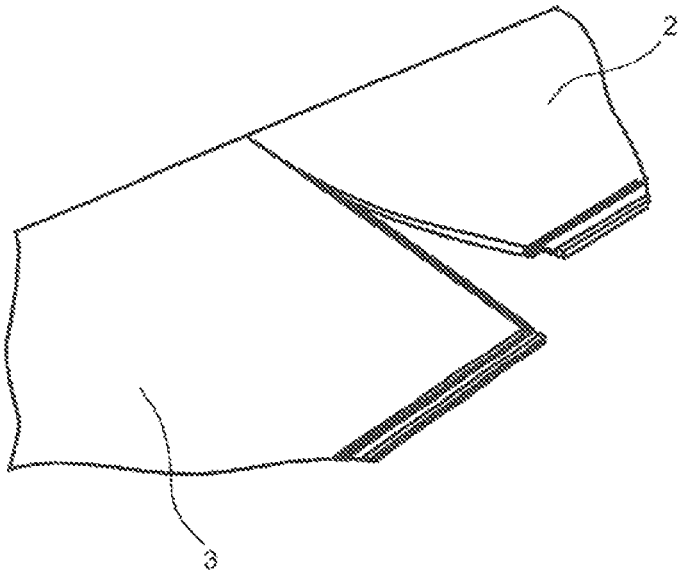

An embodiment of a method of assembling resilient floorboards (1, 2, 3) with a mechanical locking system 11 is shown in FIGS. 1*a* and 1*b*. An edge of a floorboard 2 is positioned juxtaposed another edge of another floorboard 3. The edge of the floorboard is bent (30) along the edge during the assembling and the connection of the floorboard edges to each other. In this embodiment the edge and said another edge are short edges and a long edge of the floorboard is connected to a long edge of a floorboard 1 in another row, by a mechanical angling locking system, simultaneous with the short edge connection, by an angular motion.

Figure 5A:
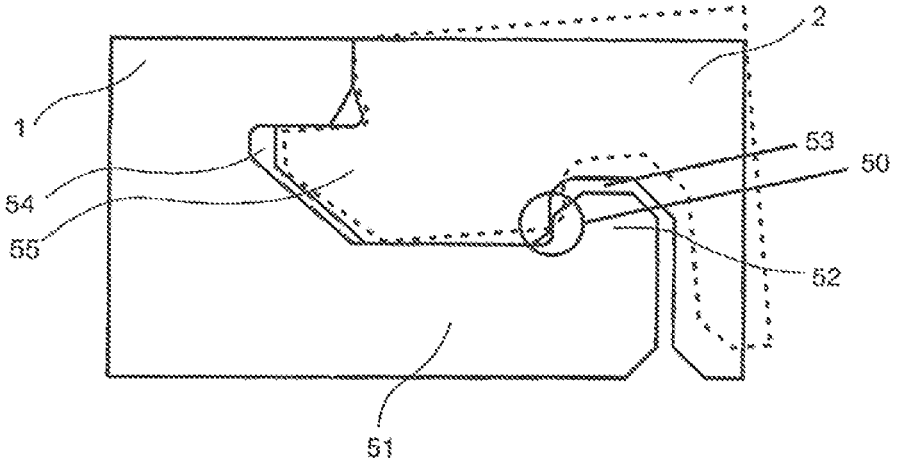
FIGS. 5*a*-5*b* show an embodiment of a locking system configured for connection by angling.
Figure 5B:
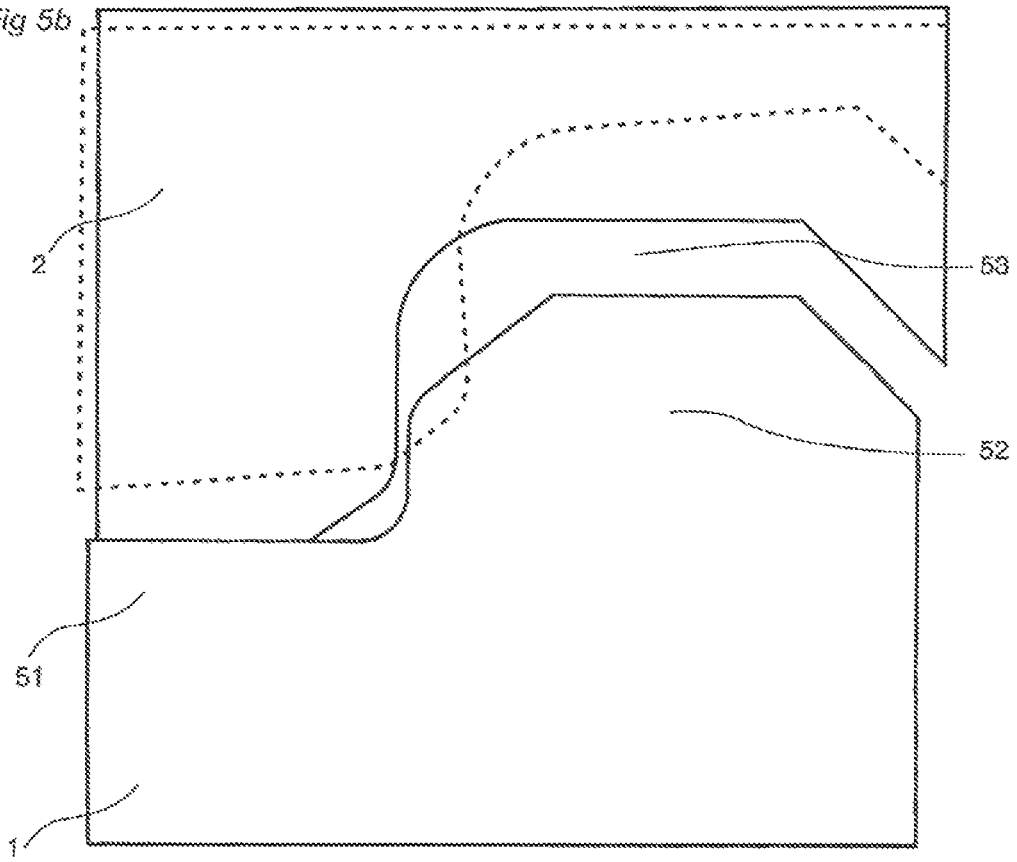

An embodiment of a mechanical angling locking system is shown in FIGS. 5*a* and 5*b*. Embodiments of the mechanical locking system 11 at the short edges is shown in FIGS. 6*a* to 9*a*. When assembling a complete floor the method shown in FIG. 1*a* is naturally applied and repeated for each resilient floorboard, which is provided with the locking system at each short edge and the mechanical angling locking system at each long side, until all resilient floorboards are connected.

The resilient floorboards may also be of square shape with the mechanical locking system 11 provided at two opposite edges of each floorboard and the mechanical angling locking system provided at two other opposite edges of each floorboard. It is also possible to provide floorboards of rectangular shape with the mechanical locking system 11 at the long edges and the mechanical angling locking system at the short edges.

Figure 2A:
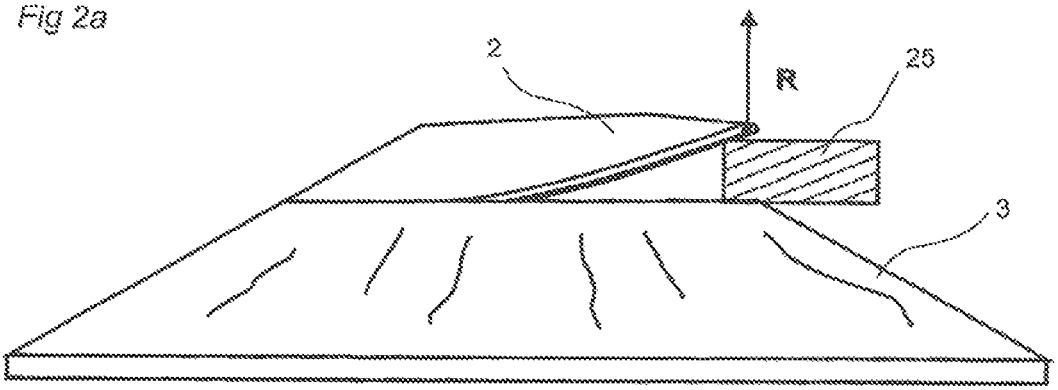
FIGS. 2*a*-2*b* show an embodiment of the assembling method.
Figure 2B:
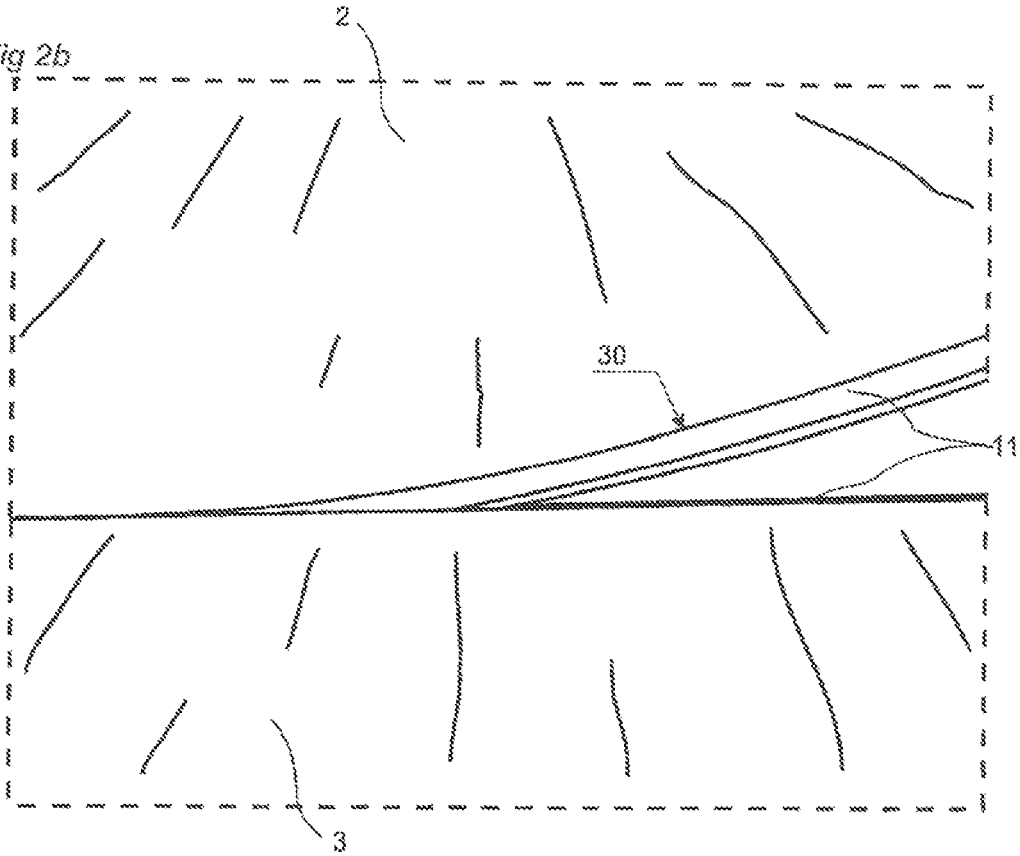
Figure 3A:
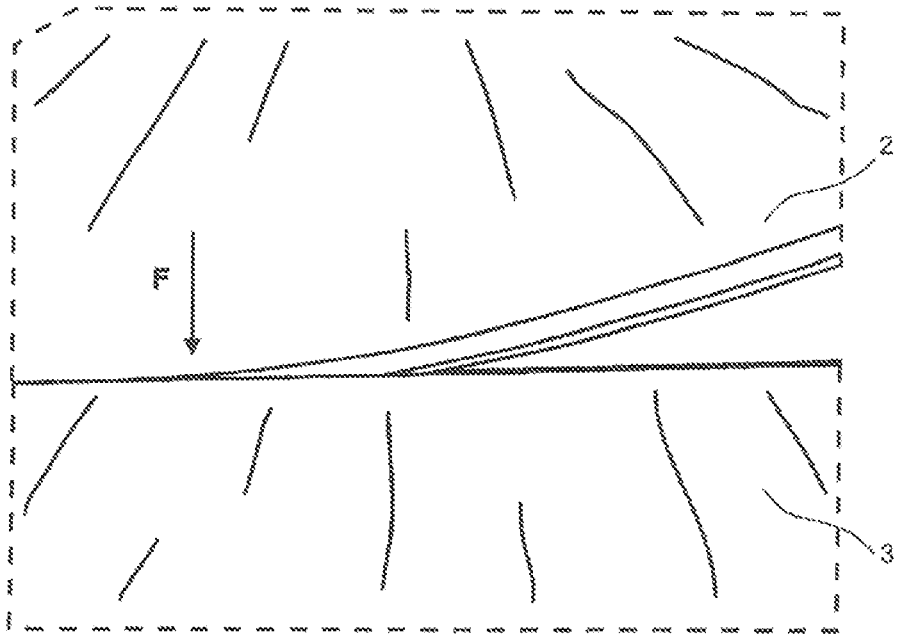
FIGS. 3*a*-3*b* show embodiments of the assembling method.

FIG. 2*a* shows the assembling from another view and FIG. 2*b* shows a detailed view of the bent (30) floorboard 2 edge and that a part of the edge is pressed down such that parts of the floorboards 2,3 are locked to each other by the mechanical locking system 11. The edge is pressed down by applying a vertical force F at the edge on the floorboard, as disclosed in FIG. 3*a*, on a part of the edge which is closest to said another edge, wherein the part of the edge is mechanically locked to another part of said another edge by the mechanically locking system 11. This is repeated until the whole edge is connected vertically and horizontally to said another edge.

The bending of the floorboard makes it possible to finalize the locking of only a part of the edge of the floorboard, instead of the whole edge as in the known methods, and as a result the force required to connect the floorboards is considerably reduced. Since only a part of the edge of the floorboard is locked the area in the mechanical locking system that is in contact during the connection is reduced and consequently the friction created in the mechanical locking is reduced and thereby the force required. The bending is preferably achieved by raising (R) an outer part of said edge by positioning of a raising device (25), e.g. a wedge, or a hand/finger of the assembler under said floorboard. The position of the raising device is maintained during the force-applying step.

Figure 3B:
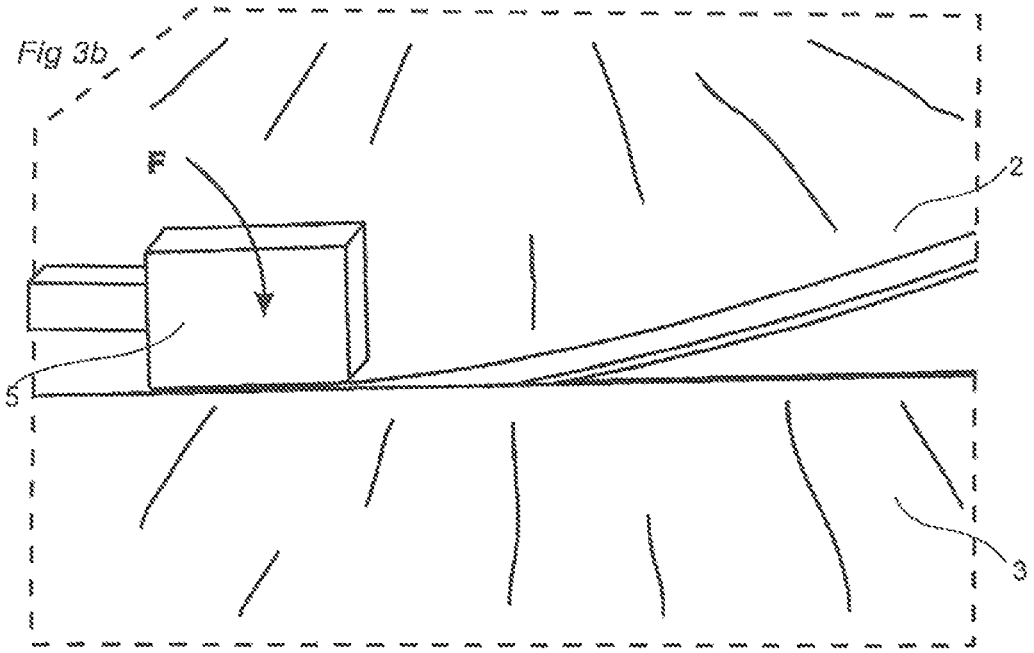
Figure 4A:
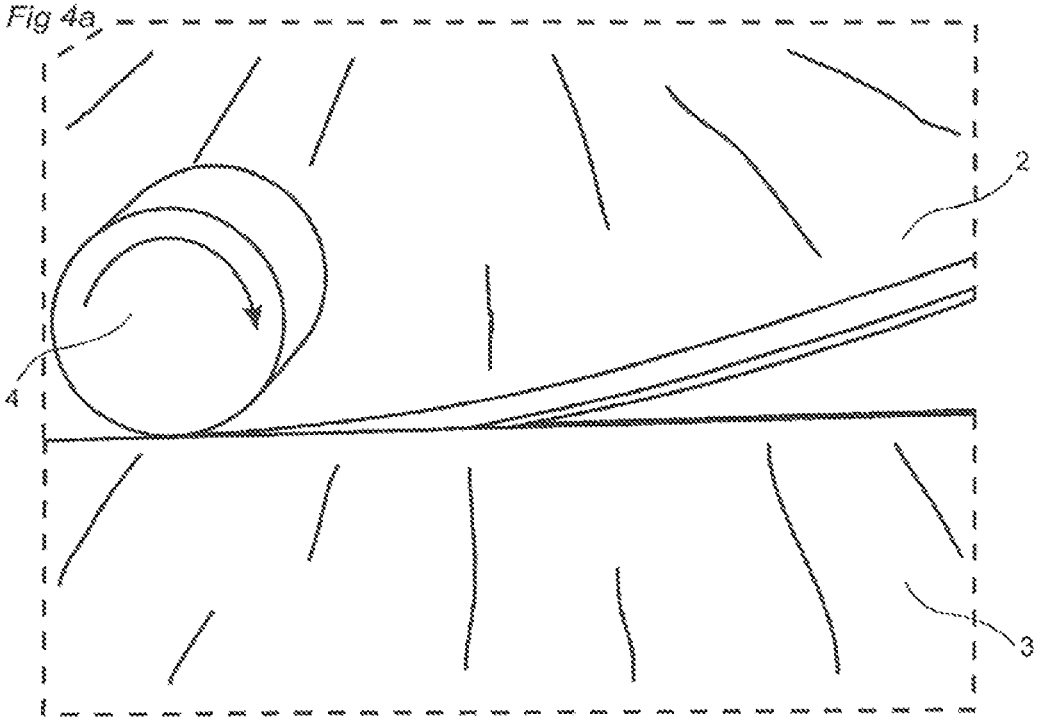
FIGS. 4*a*-4*b* show embodiments of the assembling method.
Figure 4B:
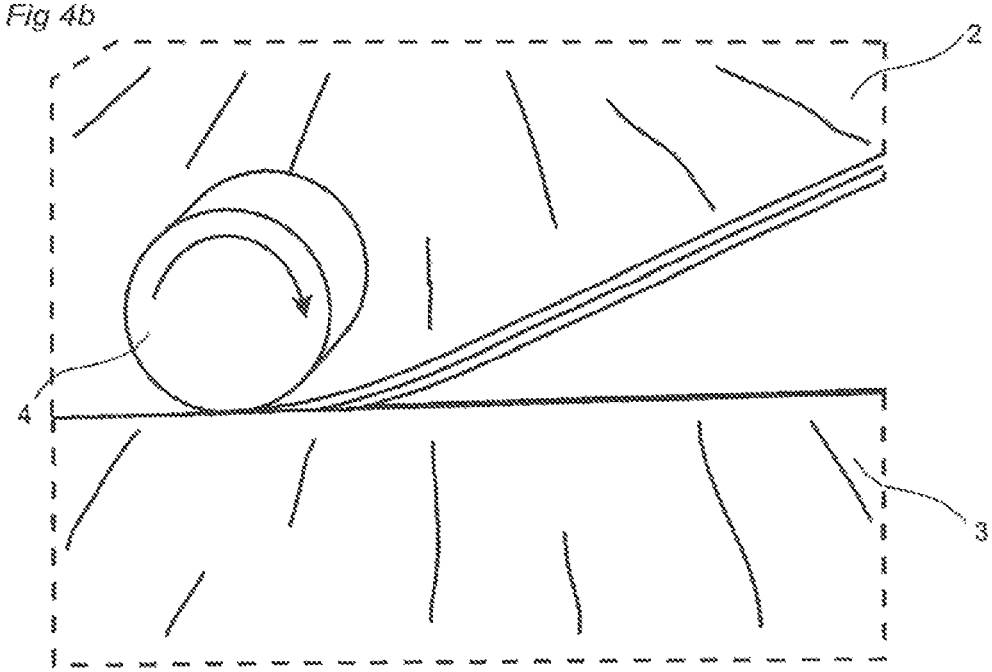

The force may be applied directly, without tools, on the floorboard e.g. by a hand or a foot of the assembler. However, a tool 4,5 may be used to apply the force as disclosed in FIGS. 3*b*, 4*a* and 4*b*. In FIG. 4*b* only a part of the floorboard is bent while the rest of the floorboard edge continues straight in the direction of the tangent of the bent part. Most preferably a tool with a rotatable press part is used to apply the force. FIG. 9*b* shows an embodiment of such a tool.

The floorboard-assembling tool in FIG. 9*b* comprises a handle 93 and press part 94, which is of a circular shape. The rotatable press part 94 makes it easy to move the tool, by one hand of the assembler, along the edge of the floorboard, which is going to be connected, and bend the floorboard with the other hand.

The mechanical angling locking system in FIG. 5*a*-*b* comprises a locking strip 51, a locking element 52 and a tongue groove 54 at an edge of a resilient floorboard 1 and a locking groove 53 and a tongue 55 at an edge of an adjacent resilient floorboard 2. The tongue 55 cooperates with the tongue groove 54 for vertical locking and the locking element 52 cooperates with the locking groove 53 for horizontal locking, similar to the angling locking systems disclosed in WO 01/77461.

Compared to the locking system, which is produced in a wood based core, disclosed in WO 01/77461 it is possible to produce a mechanical angling locking system in a resilient floorboard with a shorter locking strip and/or higher locking angle and/or increased locking surface area, as disclosed in FIG. 5*b*, which is an enlarged view of area 50 in FIG. 5*a*. This is due to the resilient material, which makes it possible to bend the locking strip more without breaking it. The angling locking system is preferably integrally formed in one piece with the resilient material of the floorboard.

Figure 6A:
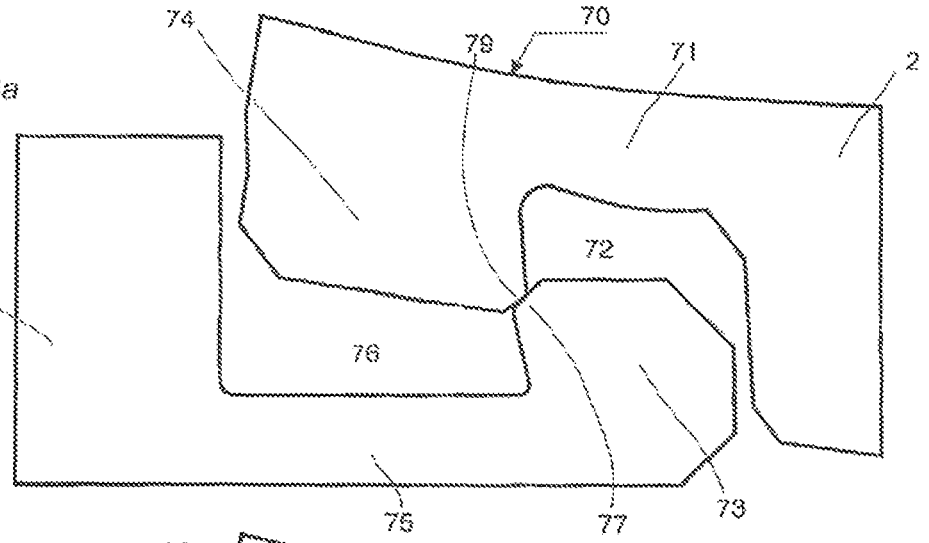
FIGS. 6*a*-6*c* show an embodiment of resilient floorboards during assembling.
Figure 6B:
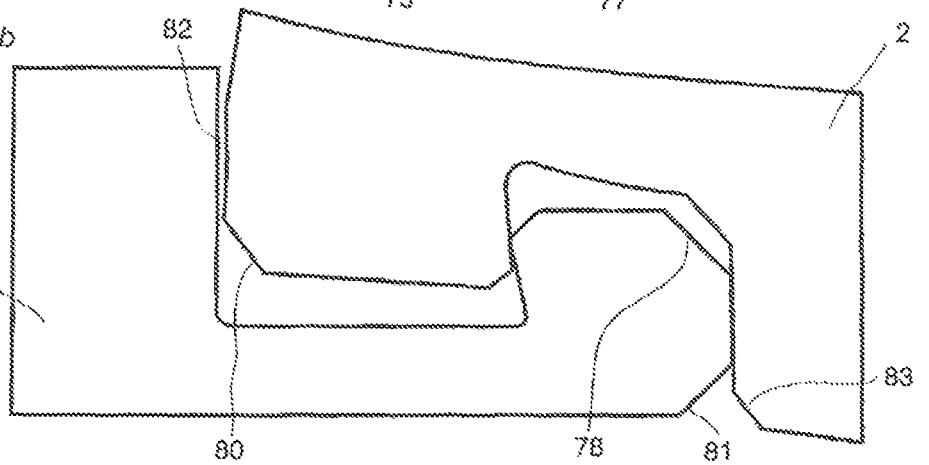
Figure 6C:
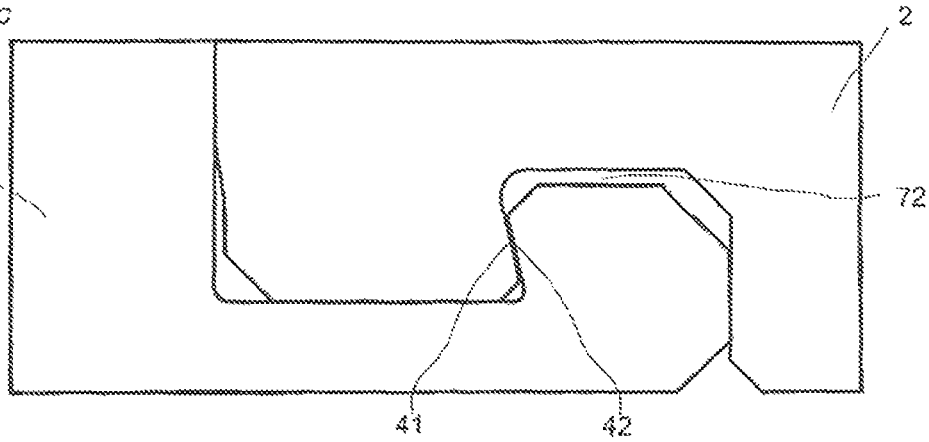

An embodiment of the mechanical locking system is disclosed in FIGS. 6*a*-6*c* in which figures a cross-section of the locking system is shown in three sequential steps during the connection. A first device of the mechanical locking system comprises an upper, and upwardly resiliently bendable, locking strip 71 at an edge of a floorboard 2 and a second device of the mechanical locking system comprises a lower locking strip 75 at an edge of another floorboard 3. The upper and the lower locking strip is provided with a downwardly and an upwardly protruding locking element 74, 73 respectively. The locking elements are provided with locking surfaces 41, 42 configured to cooperate for horizontal locking of the floorboards.

An upwardly bending of the upper locking strip 71 across the edge (see FIG. 6*a*-6*b*), facilitates a positioning of the downwardly protruding locking element 74 between the upwardly protruding locking element and an upper edge of the floorboard 3 in a position where the locking surface cooperates, as shown in FIG. 6*c*.

The downwardly protruding locking element is preferably provided with a guiding surface 79, which is configured to cooperate (see FIG. 6*a*) with the upwardly protruding locking element 73 in order to facilitate the positioning.

Preferably, the upwardly protruding locking element 73 is provided with another guiding surface 77, which is configured to cooperate (see FIG. 6*a*) with the guiding surface 79 to further facilitate the positioning.

It is also possible to only provide the upwardly protruding locking element 73 with a guiding surface, which is configured to cooperate with an edge of the downwardly protruding locking element.

The angle 44 of the guiding surface 79 and the angle of 43 said another guiding surface 77 are preferably more than about 30° and most preferably more than about 45°.

In a preferred embodiment the mechanical locking system is provided with one or more additional guiding surfaces, which guide the floorboards to the correct location for connection:

- a guiding surface 80 at the downwardly protruding locking element, which guiding surface cooperates with an upper edge of the said other floorboard; and
- a guiding surface 83 at the lower edge of the floorboard, which guiding surface cooperates with an edge or a guiding surface of the upwardly protruding locking element.

A space 81, shown in FIG. 6*b*, under the upwardly protruding locking element facilitates bending of the lower locking strip during the connection of the lower locking strip. A space 72 above the upwardly protruding locking element ensures a proper connection of the floorboards, without risking that the floorboard is prevented reaching the position were the upper surfaces of the floorboards are in the same plane.

Figure 7A:
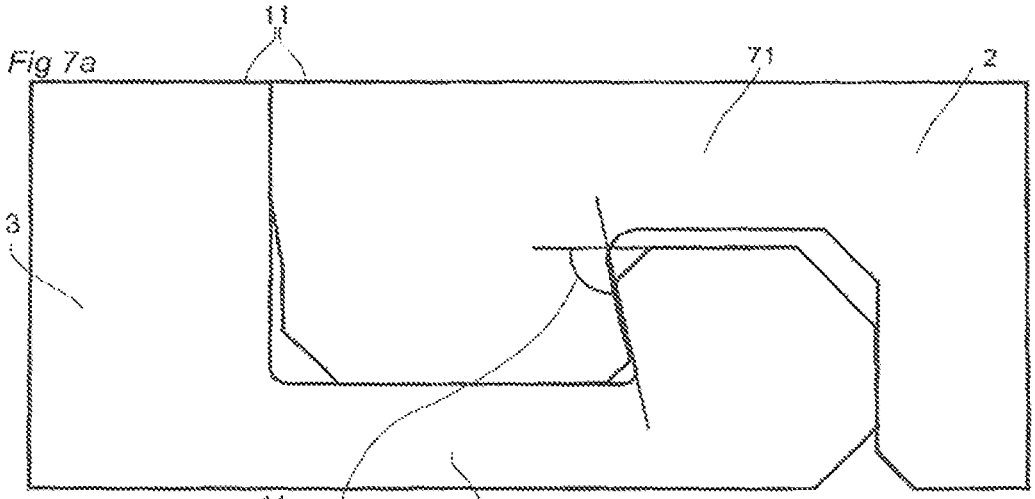
FIGS. 7*a*-7*c* show embodiments of a locking system for resilient floorboards.
Figure 7B:
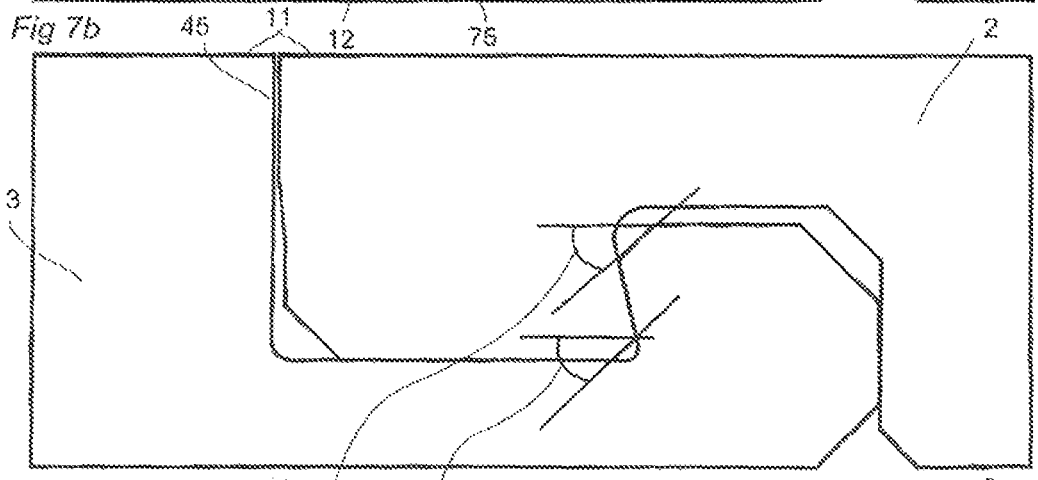
Figure 7C:
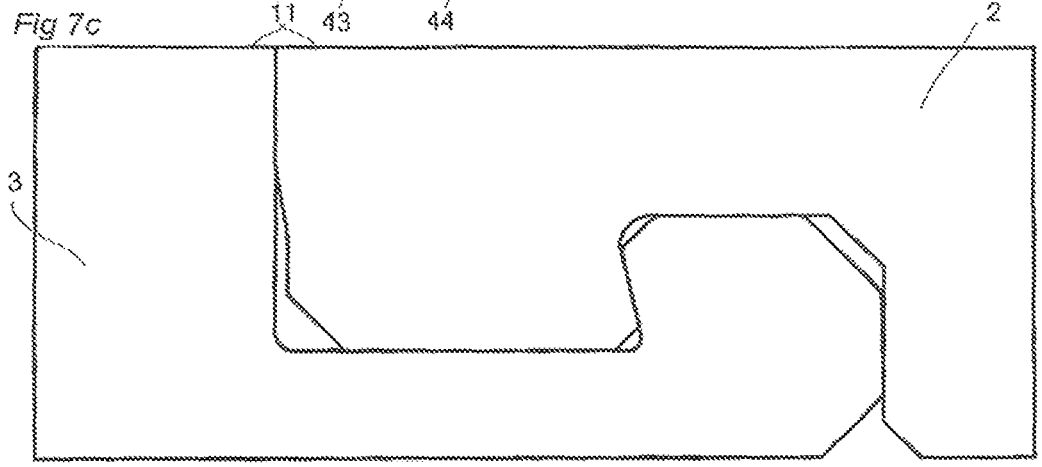
Figure 8A:
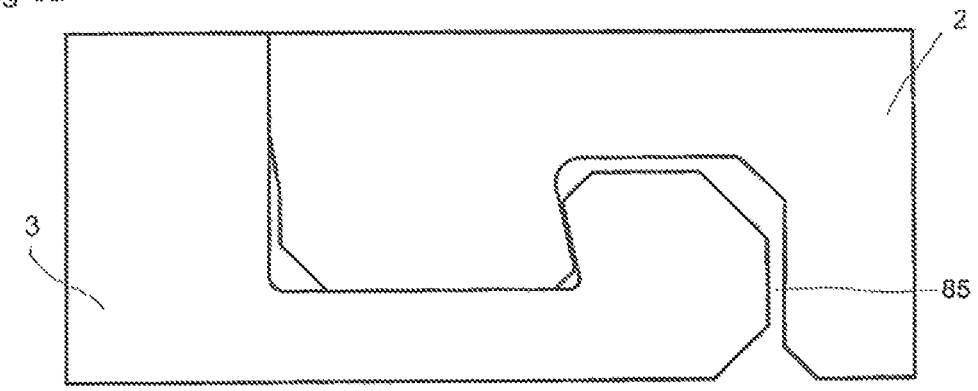
FIGS. 8*a*-8*c* show embodiments of a locking system for resilient floorboards
Figure 8B:
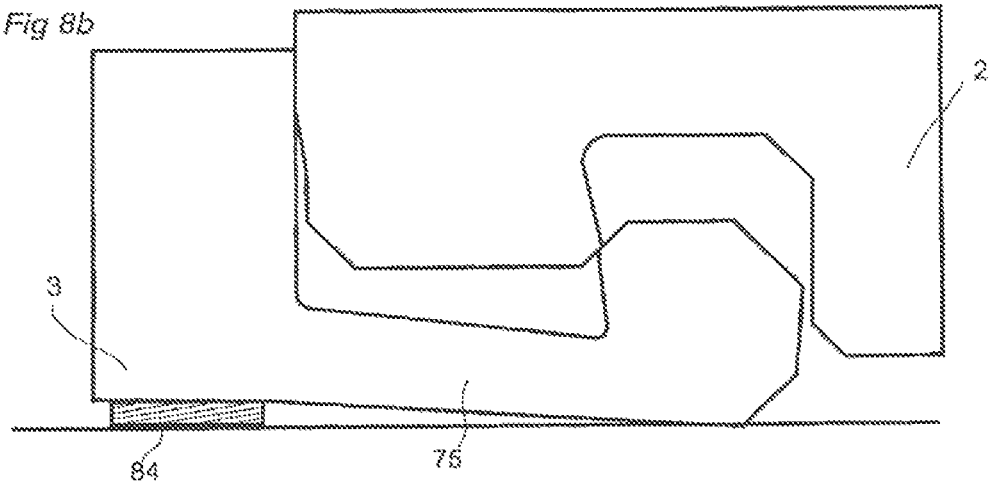
Figure 8C:
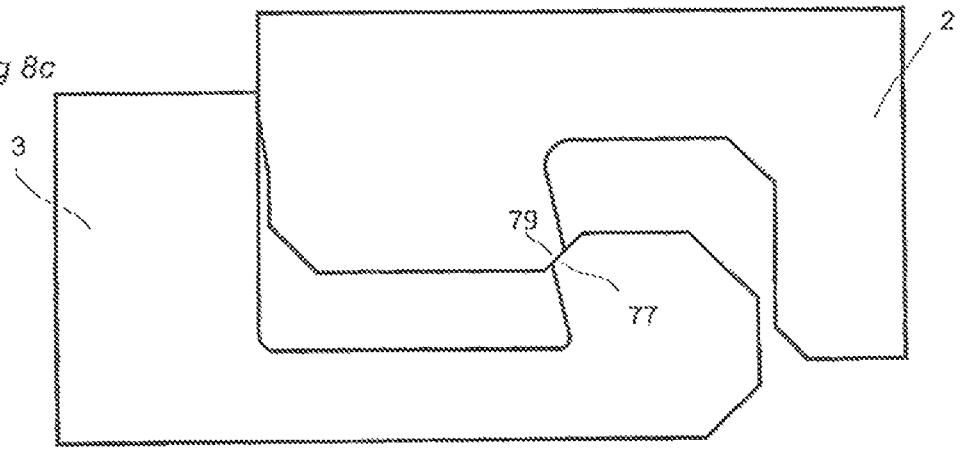

The number and area of the contact and locking surfaces should generally be minimized to ease connection of the floorboards. A small play 45 between the top edges of the floorboards (see FIG. 7*b*, 45) makes them easier to install, but a tight (see. FIG. 7*a*) fit increases the vertical locking strength. To achieve a connection which is more resistant to moisture it is possible to have contact surfaces and a tight fit between the between the lower edges of the floorboards, which also increases the vertical and horizontal locking strength. However, the tight fit also makes it harder to connect the floorboards and a space (see FIG. 8*a-c*, 85) makes it easier. An even more moisture resistant connection is achieved if the space 72 above the upwardly protruding locking element is eliminated (see FIG. 7*c*).

The angle 12 between the locking surfaces and the upper surface of the floorboards are preferably more than 90° to obtain a vertical locking in the position where the locking surface cooperates.

The locking strips 71, 75 are integrally formed in the floorboard, and preferably the whole locking system is integrally formed in one piece with the resilient material of the floorboard. However, it is possible to add separate pieces to increase the locking strength, e.g. in the form of a tongue of stiffer material, of e.g. plastic or metal of e.g. aluminum, preferably for the vertical locking.

A downwardly bending across edge of the lower locking strip 75 (see FIG. 8*b*) further facilitates the positioning of the locking elements in the position where the locking surface cooperates. Bending of the lower strip is preferably achieved by positioning of a spacer 84 between the floorboard edge and the subfloor, and inside the lower locking strip such that the lower locking strip can bend freely. It is also possible to produce a lower locking strip whose lower part is removed to create a free space between the subfloor and lower the locking strip. However, that also reduces the bending strength of the locking strip, which is not desirable since a locking strip of resilient material, e.g. vinyl, has a relatively weak resilient strength. A reduced bending strength of the locking strip means a reduced locking strength of the locking system.

Figure 9A:
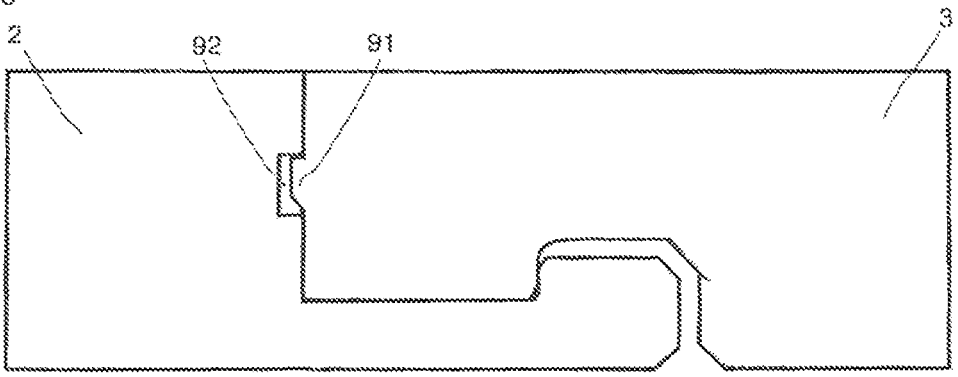
FIGS. 9*a*-9*b* show an embodiment of a locking system and an embodiment of the assembling tool.
Figure 9B:
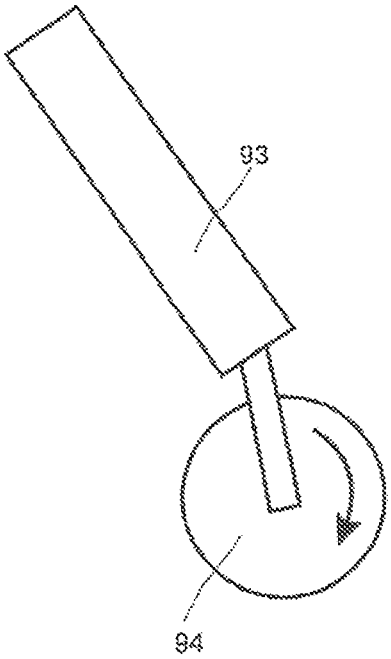

FIG. 9*a* shows an embodiment comprising a tongue 91 at the edge of a floorboard, cooperating with a tongue groove 92 at the edge of an adjacent floorboard, cooperating for vertical locking of the floorboards. The embodiment in FIG. 9*a* is provided with the tongue at the edge of the floorboard with the upper locking strip and the tongue groove at the edge of the floorboard with the lower locking strip. However it is also possible to provide the tongue at the edge of the floorboard with the lower locking strip and the tongue groove at the edge of the floorboard with the upper locking strip. These embodiments may be combined with the locking surface angle 12 that is more than 90°, as disclosed in FIGS. 6*a* to 8*c*, to obtain an increased vertical locking in the position where the locking surface cooperates.

The invention claimed is:

1. A method of assembling resilient floorboards, wherein the floorboards each include a core of a resilient material, each floorboard comprises a mechanical locking system for vertical and horizontal locking to an adjacent floorboard, wherein the mechanical locking system is integrally formed in one piece with the core, wherein the mechanical locking system comprises a first device at a first edge, and a second device at a second edge, wherein the mechanical locking system further system comprises a tongue at the first edge and a groove at the second edge for vertical locking of the floorboards, the method comprising:

connecting an adjacent edge of the first floorboard to a juxtaposed edge of a third floorboard in another row by angling;

positioning the first edge of a first floorboard juxtaposed the second edge of a second floorboard so that the first device of the mechanical locking system overlies the second device, the first edge having an outermost surface closest to the second edge of the second floorboard;

bending the first floorboard along the first edge so that the first edge has an axis of curvature that is perpendicular to the second edge of the second floorboard, the curvature being convex toward the bottom surface of the floorboards;

applying a force on a first part of the first edge, wherein at said first part of the first edge said first device is pushed into said second device to obtain a vertical and horizontal mechanical locking of a part of the first and second edges; and applying a force to a new part of the first edge, which new part is adjacent to said first part to reduce the overall force required to mechanically lock the first edge to said second edge of the second floorboard, and repeating this step until the whole first edge is vertically and horizontally locked to said second edge.

2. The method according to claim 1, wherein the bending is achieved by raising at least a part of the outermost surface of said first edge.

3. The method according to claim 2, wherein the raising is achieved by positioning of a raising device under said first floorboard in order to raise the part of the outermost surface of the first edge with respect to the juxtaposed second edge of the second floorboard.

4. The method according to claim 1, wherein the force is applied to a part of the first edge that is unlocked and closest to said second edge.

5. The method according to claim 1, wherein the force is applied by a tool.

6. The method according to claim 5, wherein the force is applied by a rotating part of the tool.

7. The method according to claim 1, wherein the first device comprises an upper locking strip and the second device comprises a lower locking strip, the upper and the lower locking strips each comprises a downwardly and an upwardly protruding locking element, respectively, each locking element comprises a locking surface configured to cooperate for horizontal locking of the floorboards, wherein the method comprises bending of the upper locking strip to a convex shape towards a bottom surface of the first floorboard during locking.

8. The method according to claim 7, wherein the lower locking strip is downwardly resiliently bendable in order to facilitate the positioning.

9. The method according to claim 7, wherein the downwardly protruding locking element comprises a first guiding surface, which is configured to cooperate with the upwardly protruding locking element in order to facilitate the positioning.

10. The method according to claim 9, wherein the first guiding surface cooperates with a second guiding surface of the upwardly protruding locking element, which said second guiding surface is configured to facilitate the positioning.

11. The method according to claim 10, wherein the angle of the first guiding surface is more than about 30 degrees.

12. The method according to claim 10, wherein the angle of the first guiding surface is more than about 45 degrees.

13. The method according to claim 10, wherein the angle of said second guiding surface is more than about 30 degrees.

14. The method according to claim 10, wherein the angle of said second guiding surface is more than about 45 degrees.

15. The method according to claim 7, wherein the angle between the locking surfaces and the upper surface of the floorboards is more than 90 degrees to obtain a vertical locking in a position where the locking surfaces cooperate.

16. The method according to claim 8, the method further comprising bending the lower locking strip.

17. The method according to claim 16, wherein the bending of the lower locking strip is achieved by positioning a spacer between the second floorboard and the subfloor and offset from the lower locking strip such that the lower locking strip can bend freely.

18. The method according to claim 1, wherein the resilient material is a thermoplastic material.

* * * * *